US010822577B2

(12) United States Patent
van Buskirk

(10) Patent No.: US 10,822,577 B2
(45) Date of Patent: Nov. 3, 2020

(54) FABRIC TREATMENT METHOD FOR STAIN RELEASE

(71) Applicant: Gregory van Buskirk, Danville, CA (US)

(72) Inventor: Gregory van Buskirk, Danville, CA (US)

( * ) Notice: Subject to any disclaimer, the term of this patent is extended or adjusted under 35 U.S.C. 154(b) by 0 days.

(21) Appl. No.: 15/543,574

(22) PCT Filed: Jan. 14, 2016

(86) PCT No.: PCT/US2016/013493
§ 371 (c)(1),
(2) Date: Jul. 13, 2017

(87) PCT Pub. No.: WO2016/115408
PCT Pub. Date: Jul. 21, 2016

(65) Prior Publication Data

US 2018/0327696 A1 Nov. 15, 2018

Related U.S. Application Data

(60) Continuation-in-part of application No. 14/549,555, filed on Nov. 21, 2014, which is a continuation-in-part of application No. 12/983,864, filed on Jan. 3, 2011, now abandoned, which is a continuation-in-part of application No. 11/614,197,
(Continued)

(51) Int. Cl.

| | |
|---|---|
| ***C11D 11/00*** | (2006.01) |
| ***C11D 3/37*** | (2006.01) |
| ***C11D 3/00*** | (2006.01) |
| ***C11D 3/18*** | (2006.01) |
| ***C11D 1/62*** | (2006.01) |
| ***D06M 15/277*** | (2006.01) |
| ***D06M 15/295*** | (2006.01) |
| ***D06M 15/256*** | (2006.01) |
| ***D06M 13/02*** | (2006.01) |
| ***D06M 15/227*** | (2006.01) |

(Continued)

(52) U.S. Cl.
CPC ..... *C11D 11/0017* (2013.01); *C11D 1/62* (2013.01); *C11D 3/001* (2013.01); *C11D 3/0015* (2013.01); *C11D 3/0036* (2013.01); *C11D 3/181* (2013.01); *C11D 3/37* (2013.01); *C11D 3/3749* (2013.01); *C11D 11/0064* (2013.01); *D06M 13/02* (2013.01); *D06M 15/227* (2013.01); *D06M 15/256* (2013.01); *D06M 15/277* (2013.01); *D06M 15/295* (2013.01); *D06M 15/353* (2013.01); *D06F 35/006* (2013.01); *D06M 2200/01* (2013.01); *D06M 2200/11* (2013.01); *D06M 2200/12* (2013.01); *D06M 2200/50* (2013.01)

(58) Field of Classification Search
CPC ..... C11D 11/0017; C11D 3/37; C11D 3/001; C11D 3/0036; C11D 3/181; C11D 11/0064; C11D 1/62; D06F 35/006; D06M 15/277; D06M 15/256; D06M 15/295; D06M 15/227; D06M 15/353; D06M 13/02; D06M 2200/01; D06M 2200/11; D06M 2200/12; D06M 2200/50
See application file for complete search history.

(56) References Cited

U.S. PATENT DOCUMENTS

| | | | |
|---|---|---|---|
| 4,027,062 | A | 5/1977 | Engelbrecht et al. |
| 4,103,047 | A | 7/1978 | Zaki et al. |

(Continued)

FOREIGN PATENT DOCUMENTS

| | | | |
|---|---|---|---|
| EP | 0920486 | A2 | 6/1999 |
| EP | 0966513 | A1 | 12/1999 |

(Continued)

OTHER PUBLICATIONS

Buschle-Diller. Physicochemical properties of chemically and enzymatically modified cellulosic surfaces. Colloids and Surfaces A: Physiochem ENg. Aspects 260 (2005) p. 63-70.*
Michem Lube 743, 2019.*
Freepel 1225 MSDS, Jul. 10, 2014.*
U.S. Consumer Products Safety Commission, "Final Report on Electric Clothes Dryers and Lint Ignition Characteristics," May 2003, p. 105; http://www.cpsc.gov/library/foia/foia03/os/dryer.pdf.
"Electrokinetic Properties of Natural Fibers," C. Bellman, et al., presented at the session on Environmental Electrokinetics, International Electrokinetics Conference, Pittsburgh, PA, Jun. 15, 2004.

(Continued)

*Primary Examiner* — Amina S Khan
(74) *Attorney, Agent, or Firm* — The Firenza Group Ltd.; Sharon R. Kantor

(57) ABSTRACT

A fabric treatment composition is provided that includes at least one zeta potential modifier, a fluoropolymer and a hydrophobic agent with a melting point or glass transition temperature below 100° C., for imparting fabric protection benefits to a fabric, such as improved stain and soil resistance, oil repellency, water repellency, softness, wrinkle and damage resistance, and better hand feel. Fabric treatment compositions can be used as a pretreatment prior to washing, through soaking, or added to the treatment liquor, that is either the wash or rinse cycle of an automatic washing machine, to first provide and then maintain and refresh the fabric protection benefits imparted to the fabric, with the proviso that an intermediate rinsing step essentially devoid of added surfactant-is used after the washing cycle and prior to the fabric treatment step. Following use of a first treatment composition, protective benefits are maintained and refreshed by means of a second treatment operation employing a second treatment composition. The second treatment composition may have lower active levels of the protective agents to provide for economical and periodic maintenance of the imparted fabric protection benefits.

17 Claims, 1 Drawing Sheet

Related U.S. Application Data filed on Dec. 21, 2006, now Pat. No. 7,893,014, which is a division of application No. 10/338,350, filed on Jan. 8, 2003, now abandoned.

(60) Provisional application No. 60/371,452, filed on Apr. 9, 2002, provisional application No. 62/103,192, filed on Jan. 14, 2015.

(51) Int. Cl.
*D06M 15/353* (2006.01)
*D06F 35/00* (2006.01)

(56) References Cited

U.S. PATENT DOCUMENTS

| | | | | |
|---|---|---|---|---|
| 4,147,851 | A | 4/1979 | Raynolds | |
| 4,489,455 | A * | 12/1984 | Spendel | C11D 11/0017 510/306 |
| 4,595,518 | A | 6/1986 | Raynolds et al. | |
| 4,724,095 | A | 2/1988 | Gresser | |
| 4,742,140 | A | 5/1988 | Greenwood et al. | |
| 4,833,006 | A | 5/1989 | McKinney et al. | |
| 4,920,000 | A | 4/1990 | Green | |
| 5,019,281 | A | 5/1991 | Singer et al. | |
| 5,047,065 | A | 9/1991 | Vogel et al. | |
| 5,153,046 | A | 10/1992 | Murphy | |
| 5,350,795 | A | 9/1994 | Smith et al. | |
| 5,532,023 | A | 7/1996 | Vogel et al. | |
| 5,573,695 | A | 11/1996 | Targosz | |
| 5,674,961 | A | 10/1997 | Fitzgerald | |
| 5,681,355 | A | 10/1997 | Davis et al. | |
| 5,698,138 | A | 12/1997 | Visca et al. | |
| 5,762,648 | A | 6/1998 | Yeazell | |
| 5,789,368 | A | 8/1998 | You et al. | |
| 5,855,985 | A | 1/1999 | O'Donnell | |
| 5,910,557 | A | 6/1999 | Audenaert et al. | |
| 6,024,823 | A | 2/2000 | Rubin et al. | |
| 6,033,705 | A | 3/2000 | Isaacs | |
| 6,043,209 | A | 3/2000 | Micciche et al. | |
| 6,075,003 | A | 6/2000 | Haq et al. | |
| 6,159,548 | A | 12/2000 | Moody | |
| 6,165,545 | A | 12/2000 | Moody | |
| 6,180,740 | B1 | 1/2001 | Fitzgerald | |
| 6,180,741 | B1 | 1/2001 | Yamaguchi et al. | |
| 6,251,210 | B1 | 6/2001 | Bullock et al. | |
| 6,297,209 | B1 | 10/2001 | Kaaret et al. | |
| 6,326,447 | B1 | 12/2001 | Fitzgerald | |
| 6,379,753 | B1 | 4/2002 | Soane et al. | |
| 6,413,925 | B2 | 7/2002 | Akbarian et al. | |
| 6,478,981 | B2 | 11/2002 | Fitzgerald | |
| 6,949,498 | B2 | 9/2005 | Murphy et al. | |
| 7,893,014 | B2 | 2/2011 | van Buskirk et al. | |
| 2002/0122890 | A1 | 9/2002 | Linford et al. | |
| 2003/0116744 | A1 | 6/2003 | Kimbrell | |
| 2004/0000013 | A1 | 1/2004 | Lim | |
| 2005/0166333 | A1 * | 8/2005 | Kaaret | D06M 13/236 8/115.51 |

FOREIGN PATENT DOCUMENTS

| | | | |
|---|---|---|---|
| WO | WO 94/22595 | A1 | 10/1994 |
| WO | WO 97/47716 | A2 | 12/1997 |
| WO | WO 98/41602 | A1 | 9/1998 |
| WO | WO 02/06433 | A1 | 1/2002 |
| WO | WO 02/06580 | A1 | 1/2002 |
| WO | WO 16/115408 | A1 | 7/2016 |

OTHER PUBLICATIONS

U.S. Consumer Products Safety Commission Staff Statment on the Southwest Research Institute Report, "Internal Cabinet Temperature Evaluation of Three Models of Commercially Available Resistive Element Clothes Dryers," Jul. 2015.

"Zeta Potential: An Introduction in 30 Minutes," Technical Note MRK654-01, Malvern Instruments, Malvern, Worcestershire, UK, www.malvern.co.uk.

"Zeta Potential Without Dilution" Colloid Measurements Company, LLC, Scarsdale, NY, www.colloidmeasurements.com.

*LG Electronics, U.S.A., Inc.* v. *Whirlpool Corporation* (N.D. III. Sep. 28, 2009), 661 F.Supp.2d 940 (N.D. III.2009).

* cited by examiner

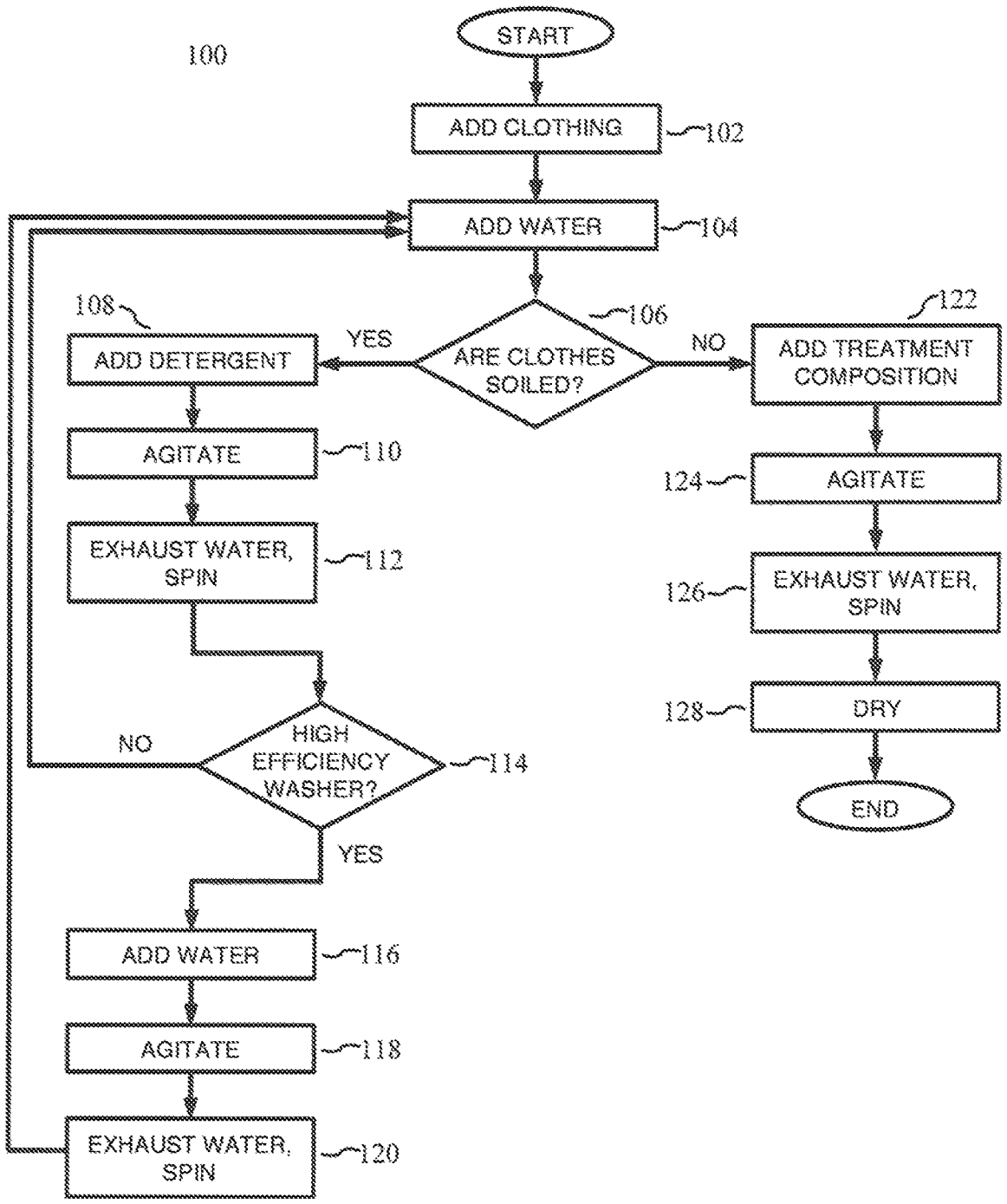
100
START
ADD CLOTHING
102
ADD WATER
104
106
ARE CLOTHES SOILED?
YES
NO
108
ADD DETERGENT
AGITATE
110
EXHAUST WATER, SPIN
112
HIGH EFFICIENCY WASHER?
114
NO
YES
ADD WATER
116
AGITATE
118
EXHAUST WATER, SPIN
120
122
ADD TREATMENT COMPOSITION
124
AGITATE
126
EXHAUST WATER, SPIN
128
DRY
END

FABRIC TREATMENT METHOD FOR STAIN RELEASE

CROSS-REFERENCE TO RELATED APPLICATIONS AND CLAIM OF PRIORITY

This application is a Continuation-in-Part of application for U.S. Ser. No. 14/549,555 filed 20 Nov. 2014, which is a Continuation-in-Part of U.S. Ser. No. 12/983,864 filed 3 Jan. 2011, which is a Continuation-in-Part of U.S. Ser. No. 11/614,197 filed 21 Dec. 2006, now U.S. Pat. No. 7,893,014, issued 22 Feb. 2011, which is a Divisional of U.S. Ser. No. 10/338,350 filed 8 Jan. 2003, and claims priority from U.S. provisional application Ser. No. 62/103,192, filed 14 Jan. 2015. All of the foregoing are incorporated fully by reference herein.

BACKGROUND

1. Technical Field

The instant disclosure relates to a fabric treatment composition for imparting fabric protection benefits to a textile, such as stain and soil resistance, oil repellency, water repellency, softness, wrinkle and damage resistance, and improved hand-feel. The composition can be used or applied as a pretreatment prior to washing, through soaking or direct spray application, or added to a treatment cycle, such as the wash or rinse cycle of an automatic washing machine. Application of the fabric treatment is complete when a treated fabric is cured by drying and/or heating.

2. Discussion of Related Art

Most textile treatment agents for stain release, water repellency and oil repellency currently require industrial baths with high concentrations of chemicals, followed by curing at high temperatures, that is, temperatures substantially above 100° C., such as those often found in commercial drying ovens. For example, U.S. Pat. No. 6,251,210 to Bullock, et al., discloses a dual system for treating textiles involving application of an aqueous primary composition having 5-20 weight % of a fluorochemical textile agent directly applied to the fabric, followed by drying, followed thereafter by applying an aqueous secondary composition directly applied to the fabric, followed by a second drying. The textile agent comprises, in addition to the fluorochemical, a urethane latex, a compatible acrylate latex and a cross-linking resin. The first composition is a low-solids latex having a glass transition temperature from 10° C. to 35° C. The second composition includes a high solids latex having the consistency of wood glue or wallpaper paste and a glass transition temperature from −40° C. to −10° C. and is applied to one side of the fabric. This combined commercial treatment system purportedly produces a fabric that is liquid repellent, stain resistant, and is easy to handle.

In another example, U.S. Pat. No. 5,047,065 to Vogel, et al., describes a combination of a perfluoroaliphatic group-bearing water/oil repellent agent dispersion, an emulsifiable polyethylene dispersion, and a soft-hand extender based on a modified hydrogen alkyl polysiloxane. The composition is padded onto fabric at a concentration of 70-150 g/L and then cured at 150° C. U.S. Pat. No. 5,019,281 to Singer, et al., describes a treatment combination including a water-soluble $C_9$-$C_{24}$ quaternary ammonium salt of alkyl phosphonic acid, a separate $C_{12}$-$C_{24}$ quaternary ammonium compound, and a dispersed polyethylene wax. The composition is padded onto fabrics at a concentration of 30 g/L and then cured at 110° C. U.S. Pat. No. 5,153,046 to Murphy describes combinations of fluorochemical textile antisoilant, lubricant, and combination of cationic and nonionic surfactants. The compositions are intended for commercial application to nylon yarns.

Water-proofing has traditionally been performed with solvent-based wax and wax-like coating commonly using paraffin wax, chlorinated paraffin waxes, and ethylene/vinyl acetate waxes such as those materials cited in U.S. Pat. No. 4,027,062 to Englebrecht, et al., and U.S. Pat. No. 4,833,006 to McKinney, et al. It is also possible to make fabrics resistant to stains caused by spilled liquid by using silicone materials, as is commonly known in the art.

Some technologies have been developed to provide a fabric benefit on direct application or as an ironing aid. For example, U.S. Pat. No. 5,532,023 to Vogel, et al. describes the post-wash use of silicones and film-forming polymers for use on damp or dry clothing to relax wrinkles. Compositions are sprayed onto fabrics and then ironed or stretched by hand for wrinkle reduction benefits. There is no indication that the compositions can be applied in the wash.

Products that are applied directly onto fabrics, for instance by spraying followed by curing with an iron or in a hot dryer at high temperatures, such as above 100° C., suffer several disadvantages. Usually, a thick or uneven coating results, which gives areas of incomplete oil and water repellency as well as a fabric hand feel that lacks softness. Such products can also decrease the porosity of fabric, resulting in uncomfortable conditions for the wearer during use. An additional drawback of direct application products is that they cannot be used on fabrics that are already stained or soiled because they lock in stains and soils. That is, they seal over a stain or soil already on a textile, rather than first dislodging it from the textile.

Fluoropolymers and hydrophobic agents have previously been suggested for laundry use. U.S. Pat. No. 6,075,003 to Haq, et al., discloses the use of fluoropolymers with cationic fabric softeners. U.S. Pat. No. 5,910,557 to Audenaert, et al., discloses the use of fluorochemical polyurethane compounds to impart oil and water repellency. Further, Haq, et al., teach that fabrics exposed to their compositions are dried or ironed at temperatures at or above 150° C., in order that the treatment affixes to the fabric.

U.S. Pat. No. 6,180,740 to Fitzgerald describes an aqueous emulsion containing a fluorochemical copolymer composition that provides oil- and water-repellency to textiles. The emulsion is apparently stable under conditions of high alkalinity, high anionic concentration, and/or high shear conditions. Fabric treatment requires drying at relative high temperatures of between 110° C. to 190° C.

U.S. Pat. No. 4,724,095 to Gresser describes a detergent composition comprising an effective amount of at least one hydrophobic/hydrophilic anti-redeposition copolymer that comprises at least one of the recurring units ethylene oxide and alkylene oxide. The purpose for the copolymer is to reduce the zeta potential of the fibers of the textile substrate to a value of 0.5 times, or less, of the zeta potential of the bare fiber. Close examination of the patent reveals that the zeta potential is determined solely for the bare and treated fabrics, that is, neither for the liquid composition nor the wash liquor, and that while the zeta potential becomes less negative, it never attains a positive charge value. An example in Gresser, labeled Test No. 2, describes a soiling composition that includes a hydrophobic compound such as paraffin. The paraffin is used to discolor a test fabric. It is noted that Gresser's goal is to completely remove the soil—and therefore the paraffin—from the fabric.

U.S. Pat. No. 6,379,753 to Soane, et al., describes methods for modifying textile materials to render them water repellant, among other things, by covalently bonding multifunctional molecules to the textile material. The multifunctional molecules are polymers with plural functional groups or regions, such as binding groups, hydrophobic groups, and hydrophilic groups and oleophobic groups.

U.S. Pat. No. 7,893,014 to van Buskirk, et al., and co-pending application U.S. Ser. No. 14/549,555 relate to a fabric treatment composition for imparting fabric protection benefits, such as stain and soil resistance, oil repellency, water repellency, softness, wrinkle and damage resistance, and improved hand-feel. The composition can be used as a pretreatment prior to washing, through soaking or direct spray application, or added to a treatment cycle, such as the wash or rinse cycle of an automatic washing machine. The fabric treatment is complete when the fabric has been cured by drying and/or heating. None of the foregoing, however, has addressed the use of high-efficiency, low-water usage type washing machines that have been gaining in popularity with consumers in recent years.

SUMMARY

The present disclosure provides non-limiting examples of fabric treatment compositions and methods for providing protective properties to a fabric or garment, especially when introduced in a high-efficiency or HE type consumer washing machine. As can be appreciated, there is a need for a product and method that combines the controlled and even coating of commercial fabric treatment operations with the convenience and ease of home use that is compatible with use in low-water or HE machines. Additionally, the coating should be curable at temperatures that are readily attainable in a residential clothes dryer. This is because curing at high temperatures can make coatings excessively durable, owing to excessive buildup over numerous treatment cycles. This, in turn, typically results in an unfavorable hand-feel.

Reduced temperature curing results in improved hand-feel, and also allows for an easily reversible and/or removable coating, if desired. Such non-permanent or transient coatings reduce total coating buildup over multiple applications or treatments, and also reduce the possibility of leaving a visible residue or other undesirable change in appearance on fabrics, such as yellowing or discoloration of white or lighted-colored fabrics. A desired textile treatment product should also not lock in pre-existing stains or soils and thereby ruin fabrics. According to the U.S. Consumer Products Safety Commission, household dryers typically attain average temperatures of at least 175° C., and under normal usage reach much higher temperatures. In fact, household clothes dryers typically achieve temperatures in the range of 250° C.-350° C. during use, see: *Final Report on Electric Clothes Dryers and Lint Ignition Characteristics*, U.S. Consumer Products Safety Commission, May 2003, p. 105; http://www.cpsc.gov/library/foia/foia03/os/dryer.pdf.

Prior art that mentions one dryer temperature, for example U.S. Pat. No. 4,920,000 to Green, makes no mention of the potentially deleterious consequences of using excessive drying temperatures. Green discloses treating a blended fabric of cotton, nylon and heat-resistant fibers with a surrogate cleaning solution, i.e., aqueous sodium hydroxide, then rinsing the fabric and drying it in a conventional home dryer to a maximum dryness at 71° C. Green does not state that 71° C. is the maximum temperature to which a fabric should be subjected, nor that 71° C. is the maximum temperature achieved in a conventional home dryer, but rather states that 71° C. was the maximum temperature that was used.

The methodology described in U.S. Pat. No. 7,893,014 to van Buskirk, et al., and co-pending application U.S. Ser. No. 14/549,555, wherein laundry is cleaned in a wash cycle, followed directly by treatment with a fabric treatment composition in a rinse cycle, is effective in classic top-loading, deep-fill washing machines where textiles are completely covered with water. The volume of water in any cycle of classic top-loading washing machines is approximately 18-20 gallons (68-76 liters). It would be natural to assume that in so-called high-efficiency (HE) washing machines, where the volume of water in any cycle is typically much less, for example, approximately 5 gallons (19 liters) per cycle. In such HE washing machines, as smaller volumes of water are used, the concentration of added fabric treatment compositions are therefore increased 3-4 fold relative to conventional top-loading washing machines, and it would be expected that more of the fabric treatment composition would therefore deposit on treated textiles Rather unexpectedly, however, such is not the case. In fact, it has surprisingly been found that comparatively speaking, the amount of fabric treatment composition that is introduced or applied to textiles in low water, high-efficiency washing machines is significantly reduced as compared to the amount of fabric treatment composition that is introduced to a textile in a low-water or HE rinse cycle directly after low-water or HE wash cycle.

BRIEF DESCRIPTION OF THE DRAWINGS

FIG. 1. is a flow chart illustrating an exemplary method of controlling a washing machine according to exemplary embodiments of the present disclosure.

DETAILED DESCRIPTION

The present disclosure therefore concerns the surprising discovery that the successful treatment of fabrics to impart stain repellency, particularly when using HE washing machines, includes introducing a fabric treatment composition into a rinse cycle that is essentially devoid of added surfactant-containing additives. In other words, introducing a textile or fabric treatment composition containing at least one zeta potential modifier, a hydrophobic agent and a fluoropolymer in a separate cycle following at least one rinse cycle that occurs after a wash cycle in a home or consumer washing machine. Through application of a textile treatment composition to textiles in such a second, separate or additional rinse cycle of a washing process, followed by curing of the textile by drying and/or heating, fabric protection benefits are imparted to a textile or garment, even when using a low-water or HE machine. These benefits, individually and collectively, increase the useful longevity of a textile or fabric that is treated with a fabric treatment compositions according to the methods and techniques disclosed herein.

Exemplary embodiments according to the present disclosure will be described in detail with reference to the accompanying drawing. Terms may be specially defined in consideration of configurations and operations of the present disclosure, and may vary depending on the intention or usual practice of a user or an operator. These terms should be defined based on the content throughout the present specification. The spirit of the present disclosure is not limited to the suggested exemplary embodiments; those skilled in the art who understand the spirit of the present disclosure may easily carry out other exemplary embodiments within the scope of the same spirit, and of course, the other exemplary embodiments also belong to the scope of the present disclosure.

It is to be understood that both the foregoing general description and the following detailed description are exemplary and explanatory only and are not restrictive of the claims that follow. As used herein, the use of the singular includes the plural unless specifically stated otherwise. As used herein, "or" means "and/or" unless stated otherwise. Furthermore, use of the term "including" as well as other forms, such as "includes," and "included," is not limiting. The section headings used herein are for organizational purposes only and are not to be construed as limiting the subject matter described.

Definitions

Words and terms of art that are used herein are to be understood in terms of the definitions provided below or in the discussions which follow for use in this specification, and then as needed as one skilled in the art would ordinarily define the words and terms.

As used herein, the terms "agitator-type" or "top-loading" or "top-loader" washing machines are understood to refer to conventional or non-HE type washing machines.

As used herein, the term "dry cycle" or "drying cycle" is understood to refer to that portion of a fabric care procedure during which heat is applied to a fabric or the fabric is left to dry in ambient air. The application of heat may occur either in a conventional home laundry dryer, or via any other technique for driving off water such as by ironing the fabric, through the use of an air blower or hot air gun, etc.

The words "fabric" and "cloth" as used herein are understood to be consistent with their traditional meaning in the textile assembly trades as synonyms for "textiles."

As used herein, the term "fabric protective benefits" or "fabric protection benefits" is understood to refer to at least one of: stain resistance, oil repellency, water repellency, softness, wrinkle and damage resistance, improved handfeel, as well as combinations of any of the foregoing. Fabric protection benefits are also understood to include reduction of fiber wear, i.e., retention of fiber tensile strength, maintenance of fabric appearance by reduction of fiber pilling, reduction of color loss or fading, inhibition of the deposition of fugitive dyes onto a fabric during a washing cycle or overall laundering process, fabric shape retention and/or fabric shrinkage reduction.

As used herein, the term "high-efficiency washing machine" or "HE washer" refers to washing machines that are designed to be more efficient than traditional washing machines in their energy and water use. See American Cleaning Institute, "*High Efficiency Washers and Detergents*", Washington D.C., 2010, available in print and online at http://www.cleaninginstitute.org/assets/1/page/he.pdf. HE washers use only about 20% to 66% of the amount of water by volume that is typically used in traditional agitator-type washers in the United States. Because there is much less water to heat, energy use in HE washers can be as little as 20 to 50 percent of the amount of energy typically required to heart water in traditional agitator washers.

As used herein, the term "laundering process," "laundry process," or "laundry cycle" is understood to refer to any and all washing, rinsing, spinning and drying to which a fabric may be subjected during a fabric treatment and/or fabric cleaning procedure.

As used herein, the term "washing cycle" or "wash cycle" refers only to that portion of a laundering process or fabric cleaning procedure in which a detergent is combined with a fabric, garment or textile in aqueous solution for the purpose of cleaning the item.

As used herein, the term "spin cycle" or "spinning cycle" is understood to refer to that portion of a fabric cleaning procedure during which residual water or aqueous solutions are removed from the fabric through wringing, centrifugal force or any combination thereof.

As used herein, the term "dry cycle" or "drying cycle" is understood to refer to that portion of a fabric care procedure during which heat is applied to a fabric or the fabric is left to dry in ambient air. The application of heat may occur either in a conventional home laundry dryer, or via any other technique to drive off water such as ironing the fabric, through use of an air blower or hot air gun, etc.

The instant disclosure is directed to a method for treating fabrics in a low-water, high-efficiency washing machine to provide at least one fabric protective property to a fabric. Accordingly, FIG. 1 at 100 illustrates an exemplary method for introducing a fabric treatment composition to a fabric. As illustrated in FIG. 1, the process begins when a user first introduces laundry into the washing machine at step 102 and adds water to the machine according to the desired machine operation at water addition step 104. If a user decides that the fabrics are soiled and/or stained at decision point 106, the user adds laundry detergent to the wash load as shown in detergent addition step 108. The user can allow the laundry to soak, but eventually the laundry is agitated in the wash liquor at agitation step 110, and after a period determined either automatically by washing machine controls or manually by a user, the wash water is exhausted from the machine, and the laundry is spun via centrifugal force as shown in exhaust water, spin step 112.

In the case of high-efficiency washers, an intermediate rinse cycle is initiated at decision step 114. Water is added to the machine according to desired machine operation as shown at water addition step 116. The user can again allow the laundry to soak in the rinse water, but eventually the laundry is agitated in the rinse liquor at agitation step 118, and after a period determined automatically by the washing machine controls or manually by a user, the rinse water is exhausted from the machine, and the laundry is spun via centrifugal force in exhaust water, spin step 120. At this point, a fabric treatment cycle is initiated. This latter process becomes the same for regular as well as high-efficiency machines. In a fabric treatment cycle, water is added to the machine according to desired machine operation at 104. A suitable dose of fabric treatment composition as described herein is added along with the water or added subsequent thereto as shown at treatment composition addition step 122. The user can again allow the laundry to soak in the treatment liquor, but eventually the laundry is agitated in the treatment liquor at agitation step 124, and after a period determined automatically by the washing machine controls or via manual override, the treatment water is exhausted from the machine, and the laundry is spun via centrifugal force as shown at exhaust water, spin step 126. The laundry is then dried in a conventional dryer, whereby the process is ended.

It will be clear to those knowledgeable in the art that the user has the choice to add an additional treatment step, in order to render even greater repellency benefit prior to use. As such, the process can be repeated without a detergent-containing wash cycle or intermediate rinse cycle, but rather begin by adding water to the machine according to the desired machine operation 104, and then proceed directly to steps 122, 124, 126, and 128.

Accordingly, in a first aspect, a method for treating fabrics in a low-water, high-efficiency washing machine to provide at least one fabric protective property to a fabric includes the steps of:

1. washing the fabric with a detergent composition comprising at least one surfactant as shown at 108, 110 and 112 of FIG. 1;
2. rinsing the fabric in a first rinse cycle that is essentially devoid of surfactant-containing additives as shown at 116, 118 and 120 of FIG. 1;
3. depositing a first fabric treatment composition onto the fabric in a second rinse cycle as shown at 122, 124 and 126 of FIG. 1, wherein the first fabric treatment composition comprises:
   a. a hydrophobic agent that does not cause significant color change nor impart discoloration to a fabric, characterized as having a melting point or glass transition temperature of less than 100° C.;
   b. a fluoropolymer; and
   c. a zeta potential modifier, such that the first treatment liquor has a zeta potential that is positive and greater than zero millivolts; and
4. curing the fabric at a temperature above ambient temperature but less than 100° C., and preferably below 70° C., as shown in drying step 128 of FIG. 1;

wherein:

i. the fabric protective property is selected from the group comprising: increased water repellency, increased oil repellency, increased soil and stain release, improved hand-feel, improved softness, improved resistance to damage, and any combination thereof;
ii. the hydrophobic agent is not a fluoropolymer;
iii. the zeta potential modifier comprises a cationic or cationically modified material; and
iv. the ratio of hydrophobic agent to zeta potential modifier is at least 1:3.

In an alternate aspect, a fabric may be treated numerous times with a fabric treatment composition during any one laundering process, with the proviso that at least one intermediate rinsing step essentially devoid of surfactant-containing additives is included after any washing cycle, but prior to any fabric treatment step or steps. Once the fabric becomes dry or has been heated to dryness, any one particular laundering process is understood to be at an end.

In yet another embodiment, a textile may be exposed to the same or a different fabric treatment composition numerous times during any one laundering procedure, with the proviso that at least one rinsing step essentially devoid of a detergent or surfactant composition occurs prior to any fabric treatment or depositing step or steps. Accordingly, a method for treating fabrics in a washing machine to provide at least one fabric protective property to a fabric comprises the first method described above, wherein the step of depositing a fabric treatment composition onto the fabric is repeated at least once.

In still another embodiment, a fabric, garment or textile that has been treated with a first fabric treatment composition that may have been applied during a laundering process, can be re-treated with either the same first fabric treatment composition during a subsequent laundering process or treated with a second fabric treatment composition during a subsequent laundering process, with the proviso that an intermediate rinsing step essentially devoid of added surfactant-containing additives takes place subsequent to the washing step and prior to the fabric treatment step. The second fabric treatment composition may comprise the same hydrophobic agent, fluoropolymer and zeta potential modifier as in the first fabric treatment composition, or they may be different. Furthermore, the second fabric treatment composition may independently contain either the same, more or less weight % amounts of each of the active components of the first fabric treatment composition. Accordingly, a method for treating a fabric in a washing machine to provide at least one fabric protective property to the fabric comprises the steps of:

1. washing the fabric with a detergent composition comprising at least one surfactant as shown at 108, 110 and 112 of FIG. 1;
2. rinsing the fabric in a first rinse cycle essentially devoid of surfactant-containing additives as shown at 116, 118 and 120 of FIG. 1;
3. depositing a first fabric treatment composition onto the fabric in a second rinse cycle that comprises a first treatment liquor as shown at 122, 124 and 126 of FIG. 1, wherein the first fabric treatment composition comprises:
   a. a first amount of a hydrophobic agent that does not cause any significant color change, nor impart any discoloration to a fabric, characterized as having a melting point or glass transition temperature of less than 100° C.;
   b. a first amount of a fluoropolymer; and
   c. a first effective amount of a zeta potential modifier, such that the first treatment liquor has a zeta potential that is positive and greater than zero millivolts; and
4. depositing a second fabric treatment composition onto the fabric in a subsequent rinse cycle that comprises a subsequent treatment liquor, i.e., repeating 122, 124 and 126 of FIG. 1, wherein the second fabric treatment composition comprises:
   d. a second amount of a hydrophobic agent that does not cause any significant color change, nor impart any discoloration to a fabric, characterized as having a melting point or glass transition temperature of less than 100° C.;
   e. a second amount of a fluoropolymer; and
   f. a second effective amount of a zeta potential modifier, such that the second treatment liquor has a zeta potential that is positive and greater than zero millivolts; and
5. curing the fabric at a drying temperature above ambient temperatures but less than 100° C. and preferably less than 70° C. as shown at drying step 128 of FIG. 1;

wherein:

i. the fabric protective property is selected from the group comprising: increased water repellency, increased oil repellency, increased soil and stain release, improved hand-feel, improved softness, improved resistance to damage, and any combination thereof;
ii. the hydrophobic agent is not a fluoropolymer;
iii. the zeta potential modifier comprises a cationic or cationically modified material;
iv. the ratio of hydrophobic agent to zeta potential modifier is at least 1:3.
v. the first fabric treatment composition may be the same as or different from the second fabric treatment composition; and
vi. the second amounts of hydrophobic agent, fluoropolymer and zeta potential modifier, respectively, are independently equal to or not equal to the first amounts of hydrophobic agent, fluoropolymer and zeta potential modifier, respectively.

In another aspect, both depositing steps 3. and 4. above, or independently either depositing step 3. or depositing step 4. above may be repeated at least once prior to curing or drying step 5.

In a still further embodiment, a method for treating a fabric to impart at least one fabric protective property to the fabric includes the steps of:

1. washing the fabric with a detergent composition comprising at least one surfactant as shown at steps 108, 110 and 112 of FIG. 1;
2. rinsing the fabric in a rinse cycle essentially devoid of added detergent or surfactant-containing additives as shown at 116, 118 and 120 of FIG. 1;
3. depositing a first fabric treatment composition onto the fabric in a second rinse cycle that comprises a first treatment liquor as shown at steps 122, 124 and 126 of FIG. 1, wherein the first fabric treatment composition comprises:
   a. a first amount of a hydrophobic agent that does not cause any significant color change, nor impart any discoloration to a fabric, characterized as having a melting point or glass transition temperature of less than 100° C.;
   b. a first amount of a fluoropolymer; and
   c. a first effective amount of a zeta potential modifier, such that the first treatment liquor has a zeta potential that is positive and greater than zero millivolts; and
4. curing the fabric at a first drying temperature above ambient temperatures but less than 100° C., preferably less than 70° C. as shown at drying step 128 of FIG. 1;
5. depositing a second fabric treatment composition onto the fabric in a subsequent laundering process that comprises a subsequent treatment liquor as shown at 122, 124 and 126 of FIG. 1, wherein the second fabric treatment composition comprises:
   d. a second amount of a hydrophobic agent that does not cause any significant color change, nor impart any discoloration to a fabric, characterized as having a melting point or glass transition temperature of less than 100° C.;
   e. a second amount of a fluoropolymer; and
   f. a second effective amount of a zeta potential modifier, such that the second treatment liquor has a zeta potential that is positive and greater than zero millivolts;
6. curing the fabric at a second drying temperature above ambient temperatures but less than 100° C., preferably less than 70° C., as shown at 128 of FIG. 1.

wherein:

i. the first fabric treatment composition may be the same as or different from the second fabric treatment composition;
ii. the second amounts of hydrophobic agent, fluoropolymer and zeta potential modifier, respectively, are independently equal to or not equal to the first amounts of hydrophobic agent, fluoropolymer and zeta potential modifier, respectively;
iii. the fabric protective property is selected from the group comprising: increased water repellency, increased oil repellency, increased soil and stain release, improved hand-feel, improved softness, improved resistance to damage, and any combination thereof;
iv. the hydrophobic agent is not a fluoropolymer;
v. the zeta potential modifier comprises a cationic or cationically modified material; and
vi. the ratio of hydrophobic agent to zeta potential modifier is at least 1:3.

In another still further embodiment, either or both of steps 3 and 4 above may independently be performed more than once prior to steps 5 and 6, respectively. Stated differently, a method for imparting a fabric protective property to a fabric may be practiced according to the above, wherein step 5, and any repetitions thereof, together with step 6 occur after the completion of step 3, and any repetitions thereof, together with step 4. According to yet a further embodiment, the drying temperatures used in the above method in curing steps 4 and 6 is less than about 70° C.

Fluoropolymer

Fluoropolymers and hydrophobic agents have previously been suggested for laundry use. As mentioned above, U.S. Pat. No. 6,075,003 to Haq, et al., discloses the use of fluoropolymers with cationic fabric softeners and U.S. Pat. No. 5,910,557 to Audenaert, et al., discloses the use of fluorochemical polyurethane compounds to impart oil and water repellency. These patents, however, did not suggest the additional use of hydrophobic agents with fluoropolymers in the wash for combined oil and water repellency, while maintaining a soft hand of the fabric. The latter is described in U.S. Pat. No. 7,893,014 to van Buskirk, et al., which is incorporated in its entirety herein.

According to the present disclosure, the fluoropolymer emulsions that are suitable for use with the fabric treatment formulations described herein may contain a discrete amount of surfactants, especially mixtures of cationic and nonionic surfactants, but such amounts, if present at all, are usually small. A generally suitable range for fluoropolymers in a first fabric treatment compositions presented herein is 0.5 to 60%, more preferred is 1 to 40%, and further preferred is 5 to 30%. The amount of fluoropolymer that may be acceptable for use in a second fabric treatment composition can be somewhat less. Thus, a second fabric treatment composition may contain from 0.1-30 weight % fluoropolymer.

The fluoropolymers employed in the fabric treatment compositions of the instant disclosure can be water insoluble oily soil repellents and may have one or more fluoroaliphatic radicals, and/or one or more perfluoroalkyl radicals and/or partially or fully fluorinated radical substituents. They can be nonionic in that they do not contain an ionized functional group such as a quaternary ammonium group. They can be cationic in that they contain an ionized or ionizable functional group, such as a quaternary ammonium group in the first instance, or a tertiary amine, which is protonatable to provide for a positive charge center. They can be zwitterionic in that they have both cationic and anionic groups present, suitably with the number of cationic and anionic groups present being essentially equivalent in number to provide an overall net nonionic property to the fluoropolymer, and also suitably with the number of cationic and anionic groups present being essentially non-equivalent in number to provide an overall net positive or cationic charge to the fluoropolymer. It is especially preferred that the fluoropolymers be at least slightly cationic, that is that, carry a net positive charge. Useful classes of the fluoropolymers are the fluorocarbonylimino biurets, the fluoroesters, the fluoroester carbamates, and the fluoropolymers. The class of fluorocarbonyliminobiurets is represented by U.S. Pat. No. 4,958,039 to Pechhold, which is incorporated herein by reference. The class of fluorocarbonylimino biurets is particularly useful because of the outstanding anti-soilant protection it provides. The class of fluoroesters is represented by U.S. Pat. No. 3,923,715 to Dettre, et al., and U.S. Pat. No. 4,029,585 to Dettre, et al., which are incorporated herein by reference. The foregoing patents disclose perfluoroalkyl esters of carboxylic acids of 3 to 30 carbon atoms. An example is the citric acid ester of perfluoroalkyl aliphatic alcohols such as a mixture of 2-perfluoroalkyl ethanols containing 8 to 16 carbon atoms. The class of fluoroester carbamates is also disclosed in aforementioned U.S. Pat. No. 4,029,585. The class of fluoropolymers is represented by U.S. Pat. No. 3,645,989 to Tandy and U.S. Pat. No. 3,645,990 to Raynolds, which are incorporated herein by reference. The patents describe, respectively, fluorinated polymers from acrylic and methacrylic derived fluoro-substituted monomers and methyl acrylate or ethylacrylate, optionally with small amounts of other monomers.

A useful fluoropolymer is the terpolymer formed by polymerization of an aliphatic or aromatic alpha olefin or an alkyl vinyl ether, a non-hydrolyzable perfluoroalkyl substituted monomer and maleic anhydride as described in U.S. Pat. No. 6,245,116 to Pechhold, et al., which is incorporated herein by reference. Useful fluoropolymers are ZONYL 8412 and ZONYL RN available from E. I. du Pont de Nemours and Company, Wilmington, Del.; SCOTCHGARD FC 255, SCOTCHGARD FC 214-230, FLUORAD series, such as FLUORAD FC 129, available from the 3M Corporation, Minnesota Mining and Manufacturing Company, St. Paul, Minn.; and TEFLON RN, TEFLON 8070, and TEFLON 8787, available from E. I. du Pont de Nemours and Company. Additional useful fluoropolymers include ZONYL 7950, ZONYL 5180, ZONYL 6885, ZONYL 7910, ZONYL 6700, ZONYL 8300, ZONYL 6991, ZONYL 310 and ZONYL NWG, all from E. I. du Pont de Nemours and Company. Useful fluoropolymers also include fluoropolymers available from Archroma, Arkema, Asahi Glass, Daikin, Goldschmidt, Hoechst Celanese, Mitsubishi, Peach State Laboratories, Shaw Industries and Trichromatic Carpet. Examples include the FOMBLIN FE-20 series of aqueous based perfluoro polyether microemulsions available from Solvay Specialty Polymers, Brussels, Belgium; fluoropolymer emulsion 3310, 3311 and Unidyne® TG-532, available from Noveon Inc. Charlotte, N.C.; fluoropolymer emulsions NINA 5006, NINA LB Liquid, NUVA LC Liquid, available from Archroma Corporation, Charlotte, N.C.; fluoropolymer REPEARL F-45, available from Mitsubishi International Corporation, NY; and MYAFIX WS and MYAFIX EX.WS, available from Peach State Labs, Rome, Ga. Other examples include NUVA FT and NUVA N2116, both fluorochemical acrylate polymers available from Archroma Corporation; SHAWGUARD 353 fluoroalkyl acrylate copolymer, available from Shaw Industries, Inc.; and BARTEX TII, BARTEX MAC, both fluoroalkylacrylate polymers, available from Trichromatic Carpets, Inc., Quebec, Canada.

Highly preferred materials of this class of fluoropolymers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Hydrophobic Agent

In general, a preferred range for hydrophobic agents in the fabric treatment compositions discussed herein is 0.5 to 60 weight %, more preferably 1 to 40 weight % and most preferably 5 to 30 weight % of the fabric treatment composition. The hydrophobic agents suitable for use herein include those which are at least partly insoluble in water at a temperature of 20° C., and which have a melting point or glass transition temperature below 100° C. and preferably between about 45° C. to about 100° C. Suitable hydrophobic agents include hydrophobic polymers, copolymers, and copolymers containing hydrophobic monomers. Suitable hydrophobic agents include hydrophobic waxes, including, but not limited to paraffin waxes. The paraffin waxes suitable for use in accordance with the instant disclosure are generally complex mixtures without a clear-cut melting point. For characterization purposes, their melting range is normally determined by differential thermo analysis or DTA, as described in "The Analyst" 87 (1962), p. 420, and/or by their solidification point. The glass transition temperature is understood to be the temperature at which wax changes from a liquid into a solid state through slow cooling. According to the instant disclosure, paraffins can be completely liquid at room temperature, i.e., those with a solidification point below 25° C., and paraffins that are solid at room temperature may both be used. The paraffin wax is preferably solid at room temperature and can be present in completely liquid form at 100° C. Suitable paraffin waxes for use in accordance with the instant disclosure may be obtained, for example, under the name of LUNAFLEX available from Fuller and under the name of DEAWAX from DEA Mineralöl AG.

Other suitable hydrophobic agents are produced from ethylenically unsaturated monomers. Examples of such monomers are styrene, acrylic acid or methacrylic acid esters of aliphatic $C_1$ to $C_{18}$ alcohols, acrylonitrile, vinyl acetate, acrylic acid and methacrylic acid. Poly(meth)acrylates of two or more of these monomers, which may optionally contain other monomers in small quantities, are particularly preferred. Most particularly preferred are polymers that contain 1 to 30 parts by weight of monomers containing carboxylic acid groups; 30 to 70 parts by weight of monomers which form homopolymers having glass temperatures below 20° C., preferably esters of acrylic acid with $C_1$ to $C_{18}$ alcohols and/or methacrylic acid with $C_1$ to $C_{18}$ alcohols; and 30 to 70 parts by weight of monomers which form homopolymers having glass transition temperatures above room temperature, preferably methacrylic acid esters of $C_1$ to $C_3$ alcohols or styrene. Examples of such polymers include the following commercial products that are available as dispersions: SYNTRAN 1501, available from Interpolymer, PRIMAL 644, available from Dow Chemical, NEOCRYL A 1049, available from DSM Coating Resins, LLC. Other preferred polymers include low molecular weight (i.e., less than 500,000 Daltons) polyethylene, low density polyethylene, polypropylene, polyolefin, polyurethane, ethylvinyl acetate, polyvinyl chloride, and copolymers. Another class of suitable hydrophobic agents are emulsifiable waxes. Emulsifiable waxes, capable of forming wax emulsions, include, for example, oxidized polyethylene, ethylene acrylic acid copolymers, and montanic acid and ester waxes available as LUWAX. Also suitable are polyolefin waxes, maleic grafted polyolefin waxes, paraffin, other hydrocarbon waxes and vegetable waxes such as carnauba and candelillia. Preferred emulsifiable waxes include polyethylene, polypropylene, oxidized polyethylene, oxidized polypropylene, ethylene acrylic copolymers, and maleic grafted polyolefins. Preferred emulsifiable waxes include polyolefins that are partially modified to contain functional groups improving dispersibility of the waxes, such functional groups include alkoxyl, carboxyl, amide, alkylamide, sulfonic, phosphonic or mixtures thereof. Suitable emulsifiable waxes also include waxes containing chemical groups that facilitate emulsification, such as carboxylic or related groups.

Examples of emulsifiable waxes include oxygen-containing wax or oxidized waxes as illustrated by those described in the following patents: natural waxes such as candelillia, carnauba, beeswax, coconut wax, montan wax, as well as oxidized petroleum waxes as illustrated by U.S. Pat. No. 2,879,237 to Groote, et al., U.S. Pat. No. 2,879,238 to Groote, et al., U.S. Pat. No. 2,879,239 to Groote, et al., U.S. Pat. No. 2,879,240 to Groote, et al., and U.S. Pat. No. 2,879,241 to Groote, et al., U.S. Pat. No. 3,163,548 to Stark, and U.S. Pat. No. 4,004,932 to Bienvenu, which are incorporated herein by reference. Other examples of suitable waxes include carboxylic adducts such as maleic and related anhydrides added to waxes such as those described in the following: U.S. Pat. No. 3,933,511 to Heintzelman, et al., and U.S. Pat. No. 3,933,512 to Heintzelman, et al., which are incorporated herein by reference. Typical examples are esters, amides, and ester-amides of compositions of one or more of the formulas disclosed in U.S. Pat. Nos. 3,933,511 and 3,933,512 which are incorporated herein by reference. Some of these waxes are sold by Petrolite Corporation under the name CERAMER.

Other preferred waxes include alkylmethicone AMS-C30 available from Dow Corning, natural candelillia (Candelillia) available from Frank B. Ross, stearoxytrimethylsilane 580 available from Dow Corning, cetyl palmitate DUB PC Stearine available from Dubois, microcrystalline petrolatum MULTIWAX B710 available from Witco, Scale paraffin available from Strahl and Pitsch, natural beeswax available from Frank B. Ross, microcrystalline wax from Ultraflex Petrolite, microcrystalline Ross wax 132911 from Frank B. Ross, microcrystalline Multiwax 110X from Witco, paraffin Altafin 135/140, petrolatum as Petrolatum Snow from Penreco, refined paraffin from Strahl and Pitsch, and paraffin Altafin 125/130. Preferably, the low melting point wax is selected from microcrystalline Multiwax W145A available from Witco, paraffin Altafin140/145 from Astor-Durachem, and microcrystalline Rosswax 1365 from Frank B. Ross. Highly preferred materials of this class of hydrophobic agents are those that do not cause any significant color change, nor impart any discoloration, such as graying or yellowing, to the fabrics to which they are applied, either during treatment, after drying and/or curing, or after the drying and/or curing step followed by normal exposure to the elements, such as air, moisture or sunlight.

The hydrophobic agents can be delivered in emulsions that are nonionic, in that they do not contain an ionized functional group such as a quaternary ammonium group. They can be cationic in that they contain an ionized or ionizable functional group, such as a quaternary ammonium group in the first instance, or a tertiary amine, which is protonatable to provide for a positive charge center. They can be zwitterionic in that they have both cationic and anionic groups present, suitably with the number of cationic and anionic groups present being essentially equivalent in number to provide an overall net nonionic property to the fluoropolymer, and also suitably with the number of cationic and anionic groups present being essentially non-equivalent in number to provide an overall net positive or cationic charge to the fluoropolymer. It is especially preferred that the hydrophobic agent ingredient be at least slightly cationic, that is that carry a net positive charge.

Liquid Carrier

The liquid carrier is preferably an aqueous system. The carrier can also contain a low molecular weight organic solvent that is highly soluble in water, e.g., $C_1$ to $C_4$ monohydric alcohols, $C_2$ to $C_6$ polyhydric alcohols, such as alkylene glycols and polyalkylene glycols, alkylene carbonates, and mixtures thereof. Examples of these water-soluble solvents include ethanol, propanol and isopropanol. Water is a preferred liquid carrier due to its low cost, availability, safety, and environmental compatibility. The water can be distilled, deionized, or tap water.

Highly preferred materials of this class of liquid carriers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure. When a concentrated composition is used, the level of liquid carrier can typically be from about 20% to about 80% of the composition, preferably from about 30% to about 70%, and more preferably from about 40% to about 60% of the composition. When a dilute composition is used, for instance in a rinse added maintenance or spray application, the amount of liquid carrier can be greater. For rinse added maintenance applications, the liquid carrier may typically range from about 50% to about 99% of the composition, preferably from about 60% to about 98%, and more preferably from about 80% to about 95% of the composition. For direct applications, employing the inventive compositions in "neat form", that is to say, undiluted form and such as for spray and aerosol applications, the liquid carrier can typically range from about 70% to about 99.9%, by weight of the composition, preferably from about 80% to about 99.5%, and more preferably from about 90% to about 99% of the composition. When used in direct treatment, that is in the form of an undiluted composition or a "neat composition" that does not require any subsequent dilution for use, levels of the inventive composition are necessarily reduced to the required level for effectiveness.

Zeta Potential Modifier

Compositions of the present disclosure include fluoropolymers and hydrophobic agents that become covalently and/or non-covalently attached to the surface of fabrics upon being cured at elevated temperatures. There is a wide range of phenomena, which can influence the fundamental interactions at the molecular and colloidal level. One of these factors is the electrokinetics. In this regard, the term zeta potential applies to the electrical charges existing in fine dispersions. Specifically, a solid particle, e.g., insoluble polymer, which is suspended in an aqueous system is surrounded by a dense layer of ions having a specific electrical charge. This layer is surrounded by another layer, more diffuse than the first, that has an electrical charge of its own. The bulk of the suspended liquid also has its own electrical charge. The difference in electrical charge between the dense layer of ions surrounding the particle and the bulk of the suspended liquid is the zeta potential, usually measured in millivolts. The zeta potential, $\xi$, is defined by Equation (I):

$$\xi=4\pi\delta q/D \quad \text{(I)}$$

where q is the charge on the particle, $\delta$ is the thickness of the zone of influence of the charge on the particle, and D is the dielectric constant of the liquid.

Without being bound by theory, it is believed that the fluoropolymers are attracted to the fabric surface owing to a combination of van der Waals attractive forces and electrostatic interactions. In the case of treating fabrics containing cellulose fibers, e.g., cotton, the surface of the fabric is negatively charged due to the presence of the carboxylic groups of the cellulose. In the case of treating fabrics containing synthetic fibers, such as polyester, nylon, polyamide and other synthetic polymers or blends, adsorbed materials such as negative compounds or negatively charged surface active materials, e.g., anionic surfactants found in detergents, can result in the surface of the fabric becoming negatively charged due the presence of these materials on the fabric surface. Without being bound by theory, it is believed that the existence of negatively charged groups or adsorbed negatively charged materials on the fabric surface may inhibit the attraction of the fluoropolymers to the fabric surface to at least to some extent.

It is believed that the adverse effect of any negative surface charge present on fabrics to be treated, regardless of the cause or source of said negative surface charge, can be reduced or avoided by introducing an appropriate amount of zeta potential modifier to adjust the zeta potential of the treatment liquor to a positive value greater than zero. Typically sufficient zeta potential modifier is added so that the zeta potential of the treatment liquor is positive and greater than zero millivolts. Preferably the zeta potential of the treatment liquor ranges from a positive value of zero to about +150 millivolts and preferably is less than about +100 millivolts. When at least one zeta potential modifier is employed, it will typically range from 0.1 to 30% of the composition. It has been found that exceeding this level leads to decreased performance. Without being bound by theory, it is believed that exceeding this level of zeta potential modifier leads to interference in depositing the desired repelling species. This discovery distinguishes the instant disclosure from prior art that employs zeta potential modifiers, given that the levels in the instant disclosure are dictated by efficacy of the treatment liquor, not for stabilization of the composition.

Suitable zeta potential modifiers are cationic agents including, for example, cationic monomers, polymers, and copolymers comprising cationic monomers, wherein the cationic monomer is present at least to an extent sufficient to provide an overall net cationic nature, i.e. overall positive charge, to the copolymer. Preferred cationic agents include cationic surfactants, including, but not limited to, mono and di-methyl fatty amines, alkyl trimethyl ammonium salts, dialkyl dimethyl ammonium salts, alkyl amine acetates, trialkylammonium acetates, alkyldimethylbenzyl ammonium salts, dialkymethylbenzyl ammonium salts, alkylpyridinium halide and alkyl (alkyl substituted) pyridinium salts, alkylthiomethyl pyridinium salts, alkylamidomethyl pyridinium salts, alkylquinolinium salts, alkylisoquinolinium salts, N,N-alkylmethyl pyrollidonium salts, 1,1-dialkylpiperidinium salts, 4,4-dialkylthiamorpholinium salts, 4,4-dialkylthiamorpholinium-1-oxide salts, methyl bis(alkylethyl)-2-alkyl imidazolinium methyl sulfate (and other salts), methyl bis(alkyl amidoethyl)-2-hydroxyethyl ammonium methyl sulfate (and other salts), alkyl amidopropyldimethylbenzyl ammonium salts, carboxyalkyl-alkyldimethyl ammonium salts, alkylamine oxides, alkyl dimethyl amine oxides, poly(vinylmethyl pyridinium) salts, poly(vinyl pyridine) salts, polyethyleneimines, trialkyl phosphonium bicarbonates (and other salts), trialkylmethyl phosphonium salts, alkylethylmethyl sulfonium salts, and alkyldimethyl sulfoxonium salts.

Suitable zeta potential modifiers further include cationic (i.e. bearing one or more positive charges) and cationically modified materials, including, for example, cationic and cationically modified organic polymers, cationic and cationically modified biopolymers, and cationic and cationically modified inorganic materials, including, for example, cationic and cationically modified clays, cationic and cationically modified silicas, cationic and cationically modified metal oxides and cationic and cationically modified composite materials.

Suitable organic cationic polymers include, but are not limited to, cationic cellulose derivatives, such as, for example, a quaternized hydroxyethyl cellulose which is available under the name UCARE Polymer JR 400® from Dow Chemical, cationic starch, copolymers of diallylammonium salts and acrylamides, quaternized vinylpyrrolidone/vinylimidazole polymers, such as, for example, Luviquat® (BASF), condensation products of polyglycols and amines, quaternized collagen polypeptides, such as, for example, lauryldimonium hydroxypropyl hydrolyzed collagen (Lamequat® L from BASF), quaternized wheat polypeptides, polyethyleneimine, cationic silicone polymers, such as, for example, amodimethicones, copolymers of adipic acid and dimethylaminohydroxypropyldiethylene triamine (Cartaretins® from Archroma), copolymers of acryamide with dimethyldiallylammonium chloride (Merquat 550 from Lubrizol), polyaminopolyamides, as described, for example, in FR 2252840 A, and their crosslinked water-soluble polymers, condensation products of dihaloalkyls, such as, for example, dibromobutane with bisdialkylamines, such as, for example, bisdimethylamino-1,3-propane, cationic guar gum, such as guarhydroxypropyltrimethylammonium chloride (for example, Jaguar® C-16 and Jaguar® C-17 from Solvay Rhodia; Cosmedia Guar C 261 from BASF), quaternized ammonium salt polymers, such as, for example, Mirapol®A-15, Mirapol®AD-1, Mirapol® AZ-1 from Solvay Rhodia, and cationically modified starches, as for example, Softgel BDA and Softgel BD, both from Avebe."

Additional cationic compounds suitable for use as zeta potential modifiers include amine acid salts; polyacryamidopropyltrimmonium chloride; betaines, such as but not limited to, alkyl betaines, alkyl amido betaines, imidazolinium betaines; quaternized poly(vinylpyridine); amidoamine acid salts; poly(imine) acid salts; polyethylene imine acid salts; cationic polyacryamides; poly(vinylamine) acid salts; cationic ionene polymers; poly(vinylimidazolinium salts); quaternized silicone compounds, such as but not limited to, the diquatemary polydimethyl siloxanes; poly (vinyl alcohol) quaternary materials; polydimethyldiallylammonium chloride; cationic exchange resins; anionic exchange resins; copolymers of vinylpyrrolidone and methyacrylamidopropyltrimethylammonium chloride; acidified polyvinylpolypyrrolidones; acidified copolymers of vinylpyrrolidone and vinylacetate; acidified copolymers of vinylpyrrolidone and dimethylaminoethylmetacrylate; copolymers of vinylpyrrolidone and methacrylamidopropyl trimethylammonium chloride; copolymers of quaternized vinylpyrrolidone and dimethylaminoethyl methacrylate; acidified copolymers of vinylpyrrolidone and styrene; acidified copolymers of vinylpyrrolidone and acrylic acid, and cationic polyelectrolyte polymers.

Suitable organic cationic inorganic materials suitable for use as zeta potential modifiers include, but are not limited to cationic clay, such as for example, sodium montmorillonite, hydrotalcite, vermiculite, kaolinite; clays reacted with quaternary compounds, such as, tetramethylammonium chloride; polyquarternized amines; acidified n-alkyl-2-pyrrolidones; polyacrylic acid polymers; alkyl $C_8$ to alkyl $C_{24}$ organic acids, such as but not limited to, lauric acid, satiric acid; and combinations thereof.

Suitable metal oxides and composites include cationically modified metal oxides and layered metal oxide composites, for example, but not limited to, oxides of silicon, germanium, selenium, chromium, titanium, aluminum, gallium, nickel, iron, copper, silver, gold, platinum, magnesium and calcium, and mixtures and/or layered composites thereof.

Suitable zeta potential modifiers further include cationically modified silicas, such as those disclosed in U.S. App. No. 20030157804, which is incorporated herein by reference.

Suitable zeta potential modifiers further include chitosans, which are cationic biopolymers under the pH conditions, and cationic chitin derivatives, such as, for example, quaternized chitosan, optionally in microcrystalline distribution. Examples are disclosed in Ullmann's Encyclopedia of Industrial Chemistry, 5th Ed., Vol. A6, Weinheim, Verlag Chemie, 1986, p. 231-232, which is incorporated herein by reference.

Preferred forms of the zeta potential modifiers described herein include water soluble, water dispersible and water insoluble suspensions, dispersions or emulsions of these zeta potential modifiers. Preferred forms of the inorganic and polymeric based zeta potential modifiers include fine particulates for improved dispersibility in the compositions discussed herein. Preferred forms of the inorganic and polymeric zeta potential modifiers include particulates having particle sizes in the micron and nanometer size ranges. Preferred sizes of particulates, for example, include particle sizes of about 1 nanometer to about 100 microns, most preferred being particle sizes in the range of about 1 nanometer to about 1 micron.

It should be noted that the source of the zeta potential modifiers is not critical. Thus, as further demonstrated herein, commercially available fabric softeners that include cationic surfactants can be employed as a source of zeta potential modifiers. Thus, the fabric softener serves multiple functions including facilitating the attachment of the fluoropolymers and hydrophobic agents to the fabric surface. Further, multivalent cationic salts, including cations of the alkaline earth metals (Group IIA), transition metals (Groups IIIB, IVB, VB, VIB, VIIB, VIIIB, IB, IIB) and non-metal elements (Groups IIIA, IVA, VA) may be appropriate for use as zeta potential modifiers alone, combined together, or in combination with other zeta potential modifiers described herein.

It should further be noted that the zeta potential modifiers are included as optional ingredients of the fabric treatment composition as discussed herein. Thus when the composition is formulated for use as a treatment not in the presence of another treatment aid, for example a detergent containing anionic surfactants, or when the composition is formulated for use as a direct fabric treatment, then the zeta potential modifiers are deemed optional in that they are not needed to counteract the negatively charged species, such as anionic surfactants found in commercial detergents, that might otherwise interfere to some extent with the attraction of the fluoropolymer to the fabric surface.

Highly preferred materials of this class of zeta potential modifiers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

In general, a suitable range for zeta potential modifiers in the fabric treatment compositions presented herein is 0.1 to 30 weight %, more preferably 0.1 to 20 weight % and most preferably 0.1 to 5 weight % of the fabric treatment composition. The amount of zeta potential modifier that may be acceptable for use in a second fabric treatment composition remains about the same, in order to maintain the zeta potential in the treatment liquor.

Optional Ingredients

Emulsifiers

The above fluoropolymers and hydrophobic agents may require the use of emulsifiers, such as ethoxylated fatty alcohols, fatty amides, fatty acids and alkylphenols and fatty amines or salts thereof. Other preferred emulsifiers include quaternary ammonium or protonated amine cationic surfactants such as trimethyl-dodecylammonium chloride, trimethyl-hexadecylammonium chloride, dimethyl-dicocoammonium chloride, and dimethyloctadecylammonium acetate. Preferred nonionic emulsifiers include the etherification products of ethylene oxide and/or propylene oxide with glycerol monooleate, oleic acid, cetyl alcohol, pelargonic acid, stearyl alcohol, sorbitan monooleate, sorbitan monostearate.

Highly preferred materials of this class of emulsifiers are those that do not cause any significant color change, nor impart any discoloration, such as graying or yellowing, to the fabrics to which they are applied, either during treatment followed by drying, or after the drying step followed by normal exposure to the elements, such as air, moisture or sunlight exposure pH Adjusters Ideally, when an aliquot of a fabric treatment composition disclosed herein is added to water, the pH of the resulting aqueous solution should be in the range from about 2 to about 11. Adjustment of pH can be carried out by including a small quantity of an acid in the fabric treatment composition. Because no strong pH buffers need be present, only small amounts of acid may be required. The pH may be adjusted with inorganic or organic acids, for example hydrochloric acid or alternatively with monobasic or dibasic organic acids, such as acetic acid, maleic acid or in particular glycolic acid. Additional acids that can be used include, but are not limited to, methyl sulfonic, hydrochloric, sulfuric, phosphoric, citric, maleic, and succinic acids. Adjustment of pH may be carried out by including a small quantity of a base in the formulation. Because no strong pH buffers need be present, only small amounts of base may be required. The pH may be adjusted with inorganic bases, including, but not limited to, alkali metal or alkaline earth metal salts of hydroxides, carbonates, bicarbonates, borates, sulfonates, phosphates, phosphonates and silicates. The pH may be adjusted with organic bases, including, but not limited to, salts of monocarboxylic acids, salts of dicarboxylic acids, salts of citric acid and other suitable organic acids with water soluble conjugate bases presented previously herein. The pH may be adjusted with organic bases such as the alkanolamines including methanol, ethanol and propanol amines, including dimethanol, diethanol and dipropanol amines, and including trimethanol, triethanol and tripropanol amines.

Highly preferred materials for pH adjusters are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Silicones

An optional silicone component can be used in an amount from about 0.1% to about 6% of the composition, preferably from 0.1 to 3% of the total fabric treatment composition, in order to assist in imparting water repellency to a textile. Both silicones and organopolysiloxanes may be used. In addition to the known dialkylpolysiloxanes, it is possible to use, in particular, hydrophilizing silicones, such as dimethylpolysiloxanes which contain incorporated epoxy groups and/or polyethoxy or polypropoxy or polyethoxy/propoxy groups. Preferred siloxanes include aminoethylaminopropyl dimethyl siloxane, hydroxy terminated dimethyl siloxane (dimethiconol), and modified hydrogen alkyl polysiloxanes. Preferred silicones comprise cationic and amphoteric silicones, polysiloxanes, and polysiloxanes having hydrogen-bonding functional groups consisting of amino, carboxyl, hydroxyl, ether, polyether, aldehyde, ketone, amide, ester, and thiol groups. Such polysiloxanes include, but are not limited to, polyether-modified polysiloxanes, amino-modified polysiloxanes, epoxy-modified polysiloxanes, polyhydrido-modified polysiloxanes, phenol derivative-modified polysiloxanes, ABA-type polysiloxanes, including those available from OSi Specialties, Inc. (a division of Witco Corporation), under the SILWET, NUWET, NUDRY, NUSOF, MAGNASOFT trade names. Preferred silicones may include polydimethylsiloxanes of viscosity from about 100 centistokes (cs) to about 100,000 cs, and preferably from about 200 cs to about 60,000 cs and/or silicone gums. These silicones can be used in emulsified form, which can be conveniently obtained directly from the suppliers. Examples of these pre-emulsified silicones are the 60% emulsion of polydimethylsiloxane (350 cs) sold by Dow Corning Corporation under the trade name DOW CORNING 1157 Fluid and the 50% emulsion of polydimethylsiloxane (10,000 cs) sold by General Electric Company under the trade name GENERAL ELECTRIC 2140 silicones. Silicone foam suppressants can also be used. These are usually not emulsified and typically have viscosities from about 100 cs to about 10,000 cs, and preferably from about 200 cs to about 5,000 cs. Very low levels can be used, typically from about 0.01% to about 1%, and preferably from about 0.02% to about 0.5%. Another preferred foam suppressant is a silicone/silicate mixture, for example, DOW CORNING ANTIFOAM A.

Highly preferred materials of this class of silicones are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Nonionic Surfactants

The composition can contain a nonionic surfactant. When a nonionic surfactant is added to the composition, it can typically be added at a level from about 0.05% to about 30%, preferably from about 0.05% to about 20%, and more preferably from about 0.1% to about 10% of the composition.

Suitable nonionic surfactants include addition products of alkoxylating agents such as ethylene oxide (EO), propylene oxide (PO), isopropylene oxide (IPO), or butylene oxide (BO), or a mixture thereof, with fatty alcohols, fatty acids, and fatty amines. Any of the alkoxylated materials of the particular type described hereinafter can be used as the nonionic surfactant. Preferably, the nonionic surfactant is selected from the group consisting of alkylether carboxylate, alcohol ethoxylate or secondary alcohol ethoxylate, and alkyl phenyl ethoxylate or alkyl aryl ethoxylate. These nonionic surfactants may also contain a mixture of ethoxylate and propoxylate. Suitable alkylpolysaccharides for use herein are disclosed in U.S. Pat. No. 4,565,647 to Llenado and incorporated herein by reference, having a hydrophobic group containing from about 6 to about 30 carbon atoms, preferably from about 10 to about 16 carbon atoms and a polysaccharide, e.g., a polyglycoside, hydrophilic group. Further examples of suitable surfactants are described in McCutcheon's Vol. 1: Emulsifiers and Detergents, North American Ed., McCutcheon Division, MC Publishing Co., 1995, which is incorporated herein by reference.

Highly preferred materials of this class of nonionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Cationic Surfactants

The compositions discussed herein can contain a cationic surfactant. When a cationic surfactant is added to the fabric treatment compositions of the instant disclosure, it can typically be added at a level from about 0.05% to about 30%, preferably from about 0.05% to about 20%, and more preferably from about 0.1% to about 10% of the composition.

The cationic surfactant can optionally be one or more fabric softener actives. Preferred fabric softening actives include amines and quaternized amines. The following are examples of preferred softener actives: N,N-di(tallowyl-oxy-ethyl)-N.N-dimethyl ammonium chloride; N,N-di (canolyl-oxy-ethyl)-N,N-dimethyl ammonium chloride; N,N-di(tallowyloxy-ethyl)-N-methyl, N-(2-hydroxyethyl) ammonium methyl sulfate; N,N-di(canolyl-oxyethyl)-N-methyl, N-(2-hydroxyethyl) ammonium methyl sulfate; N,N-di(tallowylamidoethyl)-N-methyl, N-(2-hydroxyethyl) ammonium methyl sulfate; N,N-di(2-tallowyloxy-2-oxo-ethyl)-N,N-dimethyl ammonium chloride; N,N-di(2-canolyloxy-2-oxo-ethyl)-N,N-dimethyl ammonium chloride; N,N-di(2-tallowyloxyethylcarbonyloxyethyl)-N,N-dimethyl ammonium chloride; N,N-di(2-canolyloxyethylcarbonyloxyethyl)-N,N-dimethyl ammonium chloride; N-(2-tallowyloxy-2-ethyl)-N-(2-tallowyloxy-2-oxo-ethyl)-N,N-dimethyl ammonium chloride; N-(2-canolyloxy-2-ethyl)-N-(2-canolyloxy-2-oxo-ethyl)-N,N-dimethyl ammonium chloride, N,N,N-tri(tallowyl-oxy-ethyl)-N-methyl ammonium chloride; N,N,N-tri(canolyl-oxy-ethyl)-N-methyl ammonium chloride; N-(2-tallowyloxy-2-oxoethyl)-N(tallowyl)-N,N-dimethyl ammonium chloride; N-(2-canolyloxy-2-oxoethyl)-N-(canolyl)-N,N-dimethyl ammonium chloride; 1,2-ditallowyloxy-3-N,N,N-trimethylammoniopropane chloride; and 1,2-dicanolyloxy-3-N,N,N-trimethylammoniopropane chloride; and mixtures of the above actives. Particularly preferred is N,N-di(tallowyl-oxy-ethyl)-N,N-dimethyl ammonium chloride, where the tallow chains are at least partially unsaturated and N,N-di (canoloyl-oxy-ethyl)-N,N-dimethyl ammonium chloride, N,N-di(tallowyl-oxy-ethyl)-N-methyl, N-(2-hydroxyethyl) ammonium methyl sulfate; N,N-di(canolyl-oxy-ethyl)-N-methyl, N-(2-hydroxyethyl) ammonium methyl sulfate; and mixtures thereof. Additional fabric softening agents useful herein are described in U.S. Pat. No. 5,643,865 to Mermelstein, et al.; U.S. Pat. No. 5,622,925 to de Buzzaccarini, et al.; U.S. Pat. No. 5,545,350 to Baker, et al.; U.S. Pat. No. 5,474,690 to Wahl, et al.; U.S. Pat. No. 5,417,868 to Turner, et al.; U.S. Pat. No. 4,661,269 to Trinh, et al.; U.S. Pat. No. 4,439,335 to Burns; U.S. Pat. No. 4,401,578 to Verbruggen; U.S. Pat. No. 4,308,151 to Cambre; U.S. Pat. No. 4,237,016 to Rudkin, et al.; U.S. Pat. No. 4,233,164 to Davis; U.S. Pat. No. 4,045,361 to Watt, et al.; U.S. Pat. No. 3,974,076 to Wiersema, et al.; U.S. Pat. No. 3,886,075 to Bernadino; U.S. Pat. No. 3,861,870 Edwards, et al.; and European Patent Application publication No. 472,178, to Yamamura, et al.; all of said documents being incorporated herein by reference.

Other suitable cationic surfactants include ethoxylated quaternary ammonium surfactants. Some preferred ethoxylated quaternary ammonium surfactants include PEG-5 cocoammonium methosulfate; PEG-15 cocoammonium chloride; PEG-15 oleoammonium chloride; and bis(polyethoxyethanol) tallow ammonium chloride. Further examples of suitable surfactants are described in McCutcheon's Vol. 1: Emulsifiers and Detergents, North American Ed., McCutcheon Division, MC Publishing Co., 1995, which is incorporated herein by reference.

The counterion to these cationic surfactants may be selected, without limitation, from the group consisting of fluoride, chloride, bromide, iodide, chlorite, chlorate, hydroxide, hypophosphite, phosphite, phosphate, carbonate, formate, acetate, lactate, and other carboxylates, oxalate, methyl sulfate, ethyl sulfate, benzoate, and salicylate, and the like. Highly preferred materials of this class of cationic surfactants and their counterions are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Amphoteric and Zwitterionic Surfactants

The fabric treatment compositions of the instant disclosure can contain amphoteric and/or zwitterionic surfactants. When an amphoteric or zwitterionic surfactant is added to the fabric treatment compositions discussed herein, it can typically be added at a level from about 0.05% to about 30%, preferably from about 0.05% to about 20%, and more preferably from about 0.1% to about 10% of the composition.

Suitable amphoteric surfactants include amine oxides having the formula $(R_1)(R_2)(R_3)NO$ wherein each of $R_1$, $R_2$ and $R_3$ is independently a saturated substituted or unsubstituted, linear or branched hydrocarbon chains of from 1 to 30 carbon atoms. Preferred amine oxide surfactants to be used according to the present disclosure include amine oxides having the formula $(R_1)(R_2)(R_3)NO$ wherein $R_1$ is an hydrocarbon chain comprising from 1 to 30 carbon atoms, preferably from 6 to 20, more preferably from 8 to 16, further preferably from 8 to 12, and wherein $R_2$ and $R_3$ are independently substituted or unsubstituted, linear or branched hydrocarbon chains comprising from 1 to 4 carbon atoms, preferably from 1 to 3 carbon atoms, and more preferably are methyl groups. $R_1$ may be a saturated substituted or unsubstituted, linear or branched hydrocarbon chain. Suitable amine oxides for use herein are, for instance, naturally derived hydrocarbon blends of $C_8$-$C_{10}$ amine oxides as well as $C_{12}$-$C_{16}$ amine oxides commercially available from Hoechst.

Suitable zwitterionic surfactants may contain both cationic and anionic hydrophilic groups on the same molecule at a relatively wide pH range. A typical cationic group is a quaternary ammonium group, although other positively charged groups like phosphonium, imidazolium and sulfonium groups can be used. Typical anionic hydrophilic groups are carboxylates and sulfonates, although other groups like sulfates, phosphonates, and the like can be used. A generic formula for some zwitterionic surfactants that can be used herein is $R_1$—$N'(R_2)(R_3)R_4X$— wherein $R_1$ is a hydrophobic group; $R_2$ and $R_3$ are each $C_4$ alkyl, hydroxy alkyl or other substituted alkyl group which can also be joined to form ring structures with the N; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is preferably a carboxylate or sulfonate group. Preferred hydrophobic groups $R_1$ are alkyl groups containing from 1 to 24, preferably less than 18, and more preferably less than 16 carbon atoms. The hydrophobic group can contain unsaturation and/or substituents and/or linking groups such as aryl groups, amido groups, ester groups and the like. In general, the simple alkyl groups are preferred for cost and stability reasons. Examples of amphoteric surfactants include alkylampho glycinates, and alkyl imino propionate. Highly preferred zwitterionic surfactants include betaine and sulphobetaine surfactants, derivatives thereof or mixtures thereof. The betaine or sulphobetaine surfactants are preferred herein as they are particularly suitable for the cleaning of delicate materials, including fine fabrics such as silk, wool and other naturally derived textile materials. Betaine and sulphobetaine surfactants are also extremely mild to the skin and/or fabrics to be treated that come in contact with the user's skin.

Suitable betaine and sulphobetaine surfactants to be used herein include the betaine/sulphobetaine and betaine-like detergents wherein the molecule contains both basic and acidic groups which form an inner salt giving the molecule both cationic and anionic hydrophilic groups over a broad range of pH values. Some common examples of these detergents are described in U.S. Pat. No. 2,082,275 to Daimler, et al., U.S. Pat. No. 2,702,279 to Funderburk, et al., and U.S. Pat. No. 2,255,082 to Orthner, et al., which are incorporated herein by reference. Further examples of suitable surfactants are described in McCutcheon's Vol. 1: Emulsifiers and Detergents, North American Ed., McCutcheon Division, MC Publishing Co., 1995, which is incorporated herein by reference.

Highly preferred materials of this class of amphoteric and zwitterionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Anionic Surfactants

The fabric treatment compositions disclosed herein can contain an anionic surfactant. When an anionic surfactant is included in the fabric treatment composition, it can typically be added at a level from about 0.05% to about 15%, preferably from about 0.05% to about 5%, and more preferably from about 0.1% to about 1% of the composition.

Suitable anionic surfactants include $C_8$-$C_{18}$ alkyl sulfonates, $C_{10}$-$C_{14}$ linear or branched alkyl benzene sulfonates, $C_{10}$-$C_{14}$ alkyl sulfates and ethoxysulfates (e.g., STEPANOL AMC from Stepan), and $C_9$-$C_{15}$ alkyl ethoxy carboxylates (NEODOX surfactants available from Shell Chemical Corporation). Suitable commercially available sulfonates are available from Stepan under the trade name BIO-TERGE PAS-88 as well as from the Witco Corporation under the trade name WITCONATE NAS-8, and Hostapur SAS from Hoechst Aktiengesellschaft, D-6230 Frankfurt, Germany. Anionic surfactants may be paired with organic counterions or multivalent counterions in order to prevent interference with cationic species. Further examples of suitable surfactants are described in McCutcheon's Vol. 1:

Emulsifiers and Detergents, North American Ed., McCutcheon Division, MC Publishing Co., 1995, which is incorporated herein by reference.

Highly preferred materials of this class of anionic surfactants are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Soil Release Agents

The composition can include a soil release agent that is present from about 0% to about 5%, preferably from about 0.05% to about 3%, and more preferably from about 0.1% to about 2% of the composition. Polymeric soil release agents useful with the fabric treatment compositions of the instant disclosure include copolymeric blocks of terephthalate and polyethylene oxide or polypropylene oxide, and the like. A preferred soil release agent is a copolymer having blocks of terephthalate and polyethylene oxide. More specifically, these polymers may be comprised of repeating units of ethylene terephthalate and polyethylene oxide terephthalate at a molar ratio of ethylene terephthalate units to polyethylene oxide terephthalate units from about 25:75 to about 35:65, and the polyethylene oxide terephthalate containing polyethylene oxide blocks having molecular weights from about 300 to about 2000. The molecular weight of this type of polymeric soil release agent can be in the range from about 5,000 to about 55,000. Suitable soil release agents are disclosed in U.S. Pat. No. 4,702,857 to Gosselink, U.S. Pat. No. 4,711,730 to Gosselink, et al., and U.S. Pat. No. 4,713,194 to Gosselink; U.S. Pat. No. 4,877,896 to Maldonado, et al.; U.S. Pat. No. 4,956,447 Gosselink, et al.; and U.S. Pat. No. 4,749,596 to Po, et al.; all of which are incorporated herein by reference. Especially desirable optional ingredients are polymeric soil release agents comprising block copolymers of polyalkylene terephthalate and polyoxyethylene terephthalate, and block copolymers of polyalkylene terephthalate and polyethylene glycol. The polyalkylene terephthalate blocks may preferably comprise ethylene and/or propylene groups. Many such soil release polymers are nonionic, for example, the nonionic soil release polymer described in U.S. Pat. No. 4,849,257 to Borcher, Sr., et al., which is incorporated herein by reference. The polymeric soil release agents useful in the instant disclosure can include anionic and cationic polymeric soil release agents. Suitable anionic polymeric or oligomeric soil release agents are disclosed in U.S. Pat. No. 4,018,569 to Chang, which is incorporated herein by reference. Other suitable polymers are disclosed in U.S. Pat. No. 4,808,086 to Evans, et al., which is incorporated herein by reference.

Highly preferred materials of this class of soil release polymers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Antistatic Agents

The composition can include antistatic agents, which can be present at a level from about 0% to about 5%, preferably from about 0.005% to about 5%, more preferably from about 0.05% to about 2%, and further preferably from about 0.2% to about 1% of the composition. Preferred antistatic agents include cationic surfactants, including quaternary ammonium compounds such as alkyl benzyl dimethyl ammonium chloride; dicoco quarternary ammonium chloride; coco dimethyl benzyl ammonium chloride; soya trimethyl quaternary ammonium chloride; hydrogenated tallow dimethyl benzyl ammonium chloride; and methyl dihydrogenated tallow benzyl ammonium chloride. Other preferred antistatic agents suitable for use with the fabric treatment compositions disclosed herein are alkyl imidazolinium salts. Other preferred antistatic agents are the ion pairs of, e.g., anionic detergent surfactants and fatty amines, or quaternary ammonium derivatives thereof, e.g., those disclosed in U.S. Pat. No. 4,756,850 to Nayar, which is incorporated herein by reference. Other preferred antistatic agents are ethoxylated and/or propoxylated sugar derivatives. Preferred antistatic agents include monolauryl trimethyl ammonium chloride, hydroxycetyl hydroxyethyl dimethyl ammonium chloride (available from Henkel Corporation under the trade name DEHYQUART E), and ethyl bis(polyethoxyethanol) alkyl ammonium ethyl sulfate (available from Witco Corporation under the trade name VARIQUAT 66), polyethylene glycols, polymeric quaternary ammonium salts (such as those available from Rhone-Poulenc Corporation under the MIRAPOL trade name), quaternized polyethyleneimines, vinylpyrrolidone/methacrylamidopropyl trimethylammonium chloride copolymer (available from GAF Corporation under the trade name GAFQUAT HS-100), triethonium hydrolyzed collagen ethosulfate (available from Maybrook Inc. under the trade name QUAT-PRO E), and mixtures thereof.

Highly preferred materials of this class of antistatic agents are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Fragrance

Perfumes or fragrance materials may be added to the composition. The selection of the perfume or perfumes maybe based upon the application, the desired effect on the consumer, and preferences of the formulator. The perfume selected for use with the compositions and formulations of the fabric treatment compositions presented herein may contain ingredients with odor characteristics which are preferred in order to provide a fresh impresssion on the surface to which the composition is directed, for example, those which provide a fresh impression for fabrics. Such perfume may be preferably present at a level from about 0.01% to about 5%, preferably from about 0.05% to about 3%, and more preferably from about 0.1% to about 2% of the total composition.

Preferably, the perfume may be composed of fragrance materials selected from the group consisting of aromatic and aliphatic esters having molecular weights from about 130 to about 250; aliphatic and aromatic alcohols having molecular weights from about 90 to about 240; aliphatic ketones having molecular weights from about 150 to about 260; aromatic ketones having molecular weights from about 150 to about 270; aromatic and aliphatic lactones having molecular weights from about 130 to about 290; aliphatic aldehydes having molecular weights from about 140 to about 200; aromatic aldehydes having molecular weights from about 90 to about 230; aliphatic and aromatic ethers having molecular weights from about 150 to about 270; and condensation products of aldehydes and amines having molecular weights from about 180 to about 320; and mixtures thereof. Examples of such perfumes or fragrance materials include, but are not limited to: adoxal (2,6,10-trimethyl-9-undecen-1-al), allyl amyl glycolate, allyl cyclohexane (allyl-3-cyclohexylpropionate), amyl acetate (3-methyl-1-butanol), amyl salicylate, anisic aldehyde (4-methoxybenzaldehyde), aurantiol (condensation product of methyl anthranilate and hydroxycitronellal), bacdanol (2-ethyl-4-(2,2,3-trimethyl-3-cyclopenten-1-yl)-2-buten-1-ol), benzaldehyde, benzophenone, benzyl acetate, benzyl salicylate, damascone (1-(2,6,6-trimethyl-1-cyclohexen-1-yl)-2-buten-1-one, 3-hexen-1-ol, buccoxime (1,5-dimethyl-oximebicyclo[3,2,1]octan-8-one), cedrol (octahydro-3,6,8,8-tetramethyl-1H-3A,-7-methanoazulen-6-ol), cetalox (dodecahydro-3A,6,6,9A-tetramethylnaphtho[2,1]furan), cis-3-hexenyl acetate, cis-3-hexenyl salicylate, citronellol (3,7-dimethyl-6-octenol), citronellyl nitrile (geranyl nitrile), clove stem oil, coumarin, cyclohexyl salicylate, cymal (2-methyl-3-(p-isopropylphenyl)-propionaldehyde), decyl aldehyde, damascone (1-(2,6,6-trimethyl-3-cyclohexen-1-yl)-2-buten-1-one), dihydromyrcenol (2,6-dimethyl-7-octan-2-ol), dimethyl benzyl carbinyl acetate, ethyl vanillin, ethyl-2-methyl butyrate, ethylene brassylate (ethylene tridecan-1,13-dioate), eucalyptol (1,8-epoxy-p-menthane), eugenol (4-allyl-2-methoxyphenol), exaltolide (cyclopentadecanolide), for acetate (dihydronorcyclopentadienyl acetate), florhydral (3-(3-isopropylphenyl)butanal), frutene (dihydronorcyclopentadienyl propionate), galaxolide (1,3,4,6,7,8-hexahydro-4,6,6,7,8,8-hexamethylcyclopent-gamma-2-benzopyrane), gammadecalactone (4-N-heptyl-4-hydroaldehyde), cinnamic aldehyde, hexyl salicylate, hydroxyambran (2-cyclododecylpropanol), hydroxycitronellal, ionone (4-(2,6,6-trimethyl-1-cyclohexenyl-1-yl)-3-buten-2-one), ionone (4-(2,6,6-trimethyl-1-cyclohexene-1-yl)-3-butene-2-one), ionone (4-(2,6,6-trimethyl-2-methylcyclohexyl-1-yl)-3-methyl-3-buten-2-one), 7-acetyl-1,2,3,4,5,6,7,8-octahydro-1,1,6,7-tetramethylnaphthalene, isoeugenol (2-methoxy-4-(1-propenyl)-phenol), isojasmone (2-methyl-3-(2-pentenyl)-2-cyclopenten-1-one), koavone (acetyl diisoamylene), lauric aldehyde, lavandin, lavender, natural lemon (major component d-limonene), d-limonene/orange terpenes (1-methyl-4-isopropenyl-1-cyclohexene), linalool (3-hydroxy-3,7-dimethyl-1,6-octadiene), linalyl acetate (3-hydroxy-3,7-dimethyl-1,6-octadiene acetate), Irg™ 201 (2,4-dihydroxy-3,6-dimethyl benzoic acid methyl ester), lyral (4-(4-hydroxy-4methyl-pentyl)-3-cyclohexene-1-carboxaldehyde), majantol (2,2-dimethyl-3-(3-methylphenyl)-propanol), mayol (4-(1-methylethyl)-cyclohexanemethanol), methyl anthranilate (methyl-2-aminobenzoate), methyl-alpha-naphthyl ketone, methyl cedrylone (methyl cedrenyl ketone), methyl chavicol (1-methyloxy-4,2-propen-1-yl benzene), methyl dihydrojasmonate, methyl nonyl acetaldehyde, musk indanone (4-acetyl-6-tert-butyl-1,1-dimethylindane), nerol (2-cis-3,7-dimethyl-2,6-octadien-1-ol), nonalactone (4-hydroxynonanoic acid lactone), norlimbanol (1-(2,2,6-trimethyl-cyclohexyl)-3-hexanol), orange CP (major component d-limonene), para-tert-bucinal (2-methyl-3-(p-tert-butylphenyl)propionaldehyde), p-hydroxyphenylbutanone, patchouli, phenyl acetaldehyde (1-oxo-2-phenylethane), phenyl acetaldehyde, dimethyl acetal, phenyl ethyl acetate, p-menth-1-en-8-ol, p-menth-1-en-1-ol, terpinyl acetate p-menth-1-en-8-yl acetate), tetrahydrolinalool (3,7-dimethyl-3-octanol), tetrahydromyrcenol (2,6-dimethyl-2-octanol), tonalid/musk plus (7-acetyl-1,1,3,4,4,6-hexamethyltetralin), undecalactone (4-N-heptyl-4-hydroxybutanoic acid lactone), undecavertol (4-methyl-3-decen-5-ol), undecanal, undecylenic aldehyde, vanillin (4-hydroxy-3-methoxybenzaldehyde), verdox (2-tert-butyl cyclohexyl acetate), vertenex (4-tert-butyl cyclohexyl acetate), and mixtures thereof.

The selection of such perfumes and fragrance materials is well-known to those of skill in the art, both for desired scent and appropriate scent impact. For example, when high initial perfume odor impact on fabrics is desired, it can be preferable to select a perfume containing perfume ingredients that are not too hydrophobic. The degree of hydrophobicity of a perfume ingredient can be correlated with its octanol/water partitioning coefficient P, the ratio between its equilibrium concentration in octanol and in water. Thus, a perfume ingredient with a greater partitioning coefficient P is more hydrophobic and a perfume ingredient with a smaller partitioning coefficient P is more hydrophilic; a selection based on the application and intended effect may be made accordingly. For example, in a fabric application, the preferred perfume ingredients may have an octanol/water partitioning coefficient P of about 1,000 or smaller.

Highly preferred materials of this class of fragrances and perfumes are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Antimicrobials and Preservatives

Optionally, antimicrobials or preservatives can be added to the fabric treatment compositions of the instant disclosure. Typical concentrations for biocidal effectiveness of these compounds may range from about 0.001% to about 0.8%, preferably from about 0.005% to about 0.3%, and more preferably from about 0.01% to 0.2% of the usage composition. The corresponding concentrations for the concentrated compositions are from about 0.003% to about 2%, preferably from about 0.006% to about 1.2%, and more preferably from about 0.1% to about 0.8% of the concentrated compositions.

Preservatives are especially preferred when organic compounds that are subject to microorganisms are added to the fabric treatment compositions disclosed herein, especially when they are used in aqueous compositions. When such compounds are present, long term and even short-term storage stability of the compositions and formulations becomes an important issue since contamination by certain microorganisms with subsequent microbial growth often results in an unsightly and/or malodorous solution. Therefore, because microbial growth in these compositions and formulations is highly objectionable when it occurs, it is preferable to include a solubilized water-soluble, antimicrobial presservative, which is effective for inhibiting and/or regulating microbial growth in order to increase storage stability of the preferably clear and often aqueous compositions and formulations discussed and disclosed herein.

Typical microorganisms that can be found in laundry products include bacteria, for example, *Bacillus thurigensis* (*cereus* group) and *Bacillus sphaericus*, and fungi, for example, *Aspergillus ustus*. *Bacillus sphaericus* is one of the most numerous members of *Bacillus* species in soils. In addition, microorganisms such as *Escherichia coli* and *Pseudomonas aeruginosa* are found in some water sources, and can be introduced during the preparation of aqueous solutions of the fabric treatment compositions discussed herein. It is preferable to use a broad spectrum preservative, for example, one that is effective on both bacteria (both Gram positive and Gram negative) and fungi. A limited spectrum preservative, for example, one that is only effective on a single group of microorganisms, for example, fungi, can be used in combination with a broad spectrum preservative or other limited spectrum preservatives with complimentary and/or supplementary activity. A mixture of broad spectrum preservatives can also be used. Antimicrobial preservatives useful in the present fabric treatment compositions discussed herein can be biocidal compounds, that is, substances that kill microorganisms, or biostatic compounds, that is, substances that inhibit and/or regulate the growth of microorganisms. Preferred antimicrobial preservatives include those that are water-soluble and are effective at low levels. In general, the water-soluble preservatives that may be used include organic sulfur compounds, halogenated compounds, cyclic organic nitrogen compounds, low molecular weight aldehydes, quaternary compounds, dehydroacetic acid, phenyl and phenoxy compounds, and mixtures thereof. Examples of preservatives useful in the instant fabric treatment compositions include, but are not limited to, the short chain alkyl esters of p-hydroxybenzoic acid (commonly known as parabens); N-(4-chlorophenyl)-N-(3,4-dichlorophenyl) urea (also known as 3,4,4-trichlorocarbanilide or triclocarban); 2,4,4-trichloro-2'-hydroxydiphenyl ether, commonly known as Triclosan®); a mixture of about 77% 5-chloro-2-methyl-4-isothiazolin-3-one and about 23% 2-methyl-4-isothiazolin-3-one, a broad spectrum preservative available from The Dow Chemical Company as a 1.5% aqueous solution under the trade name KATHON CG; 5-bromo-5-nitro-1,3-dioxane, available from BASF Corporation under the trade name BRONIDOX L; 2-bromo-2-nitropropane-1,3-diol, available from The Dow Chemical Company under the trade name BRONOPOL; 1,1-hexamethylenebis(5-p-(chlorophenyl)-biguanide) (commonly known as chlorhexidine) and its salts, for example, with acetic and digluconic acids; a 95:5 mixture of 1,3-bis(hydroxymethyl)-5,5-dimethyl-2,4-imidazolidinedione and 3-butyl-2-iodopropynyl carbamate, available from Lonza Inc. under the trade name GLYDANT Plus; N-[1,3-bis(hydroxymethyl)2,5-dioxo-4-imidazolidinyl]-N, N'-bis(hydroxymethyl) urea, commonly known as diazolidinyl urea, available from Ashland Inc. under the trade name GERMALL II; N,N"-methylenebis-[N'-[1-(hydroxymethyl)-2,5-dioxo-4-imidazolidinyl]urea] (commonly known as imidazolidinyl urea), available, for example, from 3V-Sigma under the trade name ABIOL, from Induchem under the trade name UNICIDE U-13, and from Ashland Inc. under the trade name GERMALL 115; polymethoxy bicyclic oxazolidine, available from Ashland Inc. under the trade name NUOSEPT; formaldehyde; glutaraldehyde; polyaminopropyl biguanide, available from Lonza Group Ltd. under the trade name COSMOCIL CQ or from Lonza Group Ltd. as MIKROKILL dehydroacetic acid; and mixtures thereof. In general, however, the preservative can be any organic preservative material that is appropriate for applying to a fabric. With respect to the embodiments presented herein, such preservative(s) will preferably not cause damage to a fabric appearance, for example, through discoloration, coloration, or bleaching of the fabric. If the antimicrobial preservative is included in the fabric treatment compositions disclosed herein, it is preferably present in an effective amount, wherein an "effective amount" means a level sufficient to prevent spoilage or prevent growth of inadvertently added microorganisms for a specific period of time. Preferred levels of preservative are from about 0.0001% to about 0.5%, more preferably from about 0.0002% to about 0.2%, further preferably from about 0.0003% to about 0.1%, of the composition. Optionally, the preservative can be used at a level that provides an antimicrobial effect on the treated fabrics.

The composition may also include a solubilized, water-soluble antimicrobial active, useful in providing protection against organisms that become attached to the treated material. The free, uncomplexed antimicrobial, e.g., antibacterial, active provides an optimum antibacterial performance. Sanitization of fabrics can be achieved by the compositions of the present disclosure containing antimicrobial materials, e.g., antibacterial halogenated compounds, quaternary compounds, and phenolic compounds. Some of the more robust antimicrobial halogenated compounds which can function as disinfectants/sanitizers as well as finish product preservatives, and are useful in the compositions of the instant disclosure include 1,1'-hexamethylene bis(5-(p-chlorophenyl)biguanide), commonly known as chlorhexidine, and its salts, e.g., with hydrochloric, acetic and gluconic acids. The digluconate salt is highly water-soluble, about 70% in water, and the diacetate salt has a solubility of about 1.8% in water. When chlorhexidine is used as a sanitizer with the fabric treatment compositions disclosed herein, it can typically be present at a level from about 0.001% to about 1.0%, preferably from about 0.002% to about 0.3%, and more preferably from about 0.01% to about 0.1%, by weight of the usage composition. In some cases, a level from about 1% to about 2% may be needed for virucidal activity. Other useful biguanide compounds include COSMOCI, CQ, VANTOCIL IB, including poly (hexamethylene biguanide) hydrochloride. Other useful cationic antimicrobial agents include the bis-biguanide alkanes. Usable water soluble salts of the above are chlorides, bromides, sulfates, alkyl sulfonates such as methyl sulfonate and ethyl sulfonate, phenylsulfonates such as p-methylphenyl sulfonates, nitrates, acetates, gluconates, and the like. Non-limiting examples of useful quaternary compounds include: (1) benzalkonium chlorides and/or substituted benzalkonium chlorides such as commercially available BARQUAT (available from Lonza), MAQUAT (available from Mason), VARIQUAT (available from Witco/Sherex), and HYAMINE (available from Lonza); (2) dialkyl quaternary such as BARDAC products of Lonza, (3) N-(3-chloroallyl) hexaminium chlorides such as DOWICIDE and DOWICIL available from Dow; (4) benzethonium chloride such as HYAMINE 1622 from Rohm & Haas; (5) methylbenzethonium chloride represented by HYAMINE 1OX supplied by Rohm & Haas, (6) cetylpyridinium chloride such as Cepacol chloride available from of Merrell Labs.

Preferred antimicrobial compounds for use herein include quaternary ammonium compounds containing alkyl or substituted alkyl groups, alkyl amide and carboxylic acid groups, ether groups, unsaturated alkyl groups, and cyclic quaternary ammonium compounds, which can be chlorides, dichlorides, bromides, methylsulphates, chlorophenates, cylcohexyl sulphamates or salts of the other acids. Among the useful cyclic quaternary ammonium compounds are the following: alkylpyridinium chlorides and/or sulphates, the alkyl group being preferably cetyl, dodecyl or hexadecyl group; -alkylisoquinolyl chlorides and/or bromides, the alkyl group being preferably dodecyl group. Particularly suitable quaternary ammonium compounds for use herein include alkyldimethylbenzyl ammonium chloride, octyl decyl dimethylammonium chloride, dioctyl dimethyl ammonium chloride, didecyl dimethyl ammonium chloride, alkyl dimethyl ammonium saccharinate, cetylpyridinium and mixtures thereof.

Highly preferred materials of this class of antimicrobials and preservatives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Dyes and Colorants

Optionally, dyes and colorants can be added to fabric treatment compositions of the instant disclosure. Typical concentrations of these compounds may range from about 0.001% to about 0.8%, preferably from about 0.005% to about 0.3%, and more preferably from about 0.01% to 0.2% of the usage composition.

Colorants and dyes, especially bluing agents, can be optionally added to the compositions of the instant disclosure for visual appeal and performance impression. When colorants are used, they may be used at extremely low levels to avoid fabric staining. Preferred colorants for use with the fabric treatment compositions discussed herein include highly water-soluble dyes, for example, LIQUITINT dyes available from Milliken Chemical Company. Non-limiting examples of suitable dyes are LIQUITINT Blue HP, LIQUITINT Blue 65, LIQUITINT Patent Blue, LIQUITINT Royal Blue, LIQUITINT Experimental Yellow 8949-43, LIQUITINT Green HMC, LIQUITINT Yellow II, and mixtures thereof. Any dye can be used in the compositions of the instant disclosure, but nonionic dyes are preferred in order to decrease interaction with the zeta potential modifier and/or with the dye transfer inhibitor. Useful acid dyes include: Polar Brilliant Blue and D&C Yellow #10, both supplied by Hilton Davis Chemical Company. Nonionic LIQUITINT dyes supplied by Milliken Chemical Company are also useful.

Suitable colors include, but are not limited to, Acid Black 1, Acid Blue 3, Acid Blue 9 Aluminum Lake, Acid Blue 74, Acid Green 1, Acid Orange 6, Acid Red 14 Aluminum Lake, Acid Red 27, Acid Red 27 Aluminum Lake, Acid Red 51, Acid Violet 9, Acid Yellow 3, Acid Yellow 3 Aluminum Lake, Acid Yellow 73, Aluminum Powder, Basic Blue 6, Basic Yellow 11, Carotene, Brilliant Black 1, Bromocresol Green, Chromium Oxide Greens, Curry Red, D&C Blue No. 1 Aluminum Lake, D&C Blue No. 4, D&C Brown No. 1, D&C Green No. 3 Aluminum Lake, D&C Green No. 5, D&C Orange No. 4 Aluminum Lake, D&C Red No. 6, D&C Red No. 6 Aluminum Lake, D&C Violet No. 2, D&C Yellow No. 7, D&C Yellow No. 11, D&C Blue No. 1, FD&C Yellow No. 5 Aluminum Lake, iron oxides, Pigment Orange 5, Pigment Red 83, Pigment Yellow 73, Solvent Orange 1, Solvent Yellow 18, ultramarines, and zinc stearate.

Highly preferred dyes and colorants for use herein are those that do not effectively bind to or permanently dye or color fabrics treated by use of the fabric treatment compositions disclosed herein, nor cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Viscosity Control Agents

Optionally added viscosity control agents can be organic or inorganic in nature and may either lower or raise the viscosity of the formulation. Examples of organic viscosity modifiers to lower viscosity are aryl carboxylates and sulfonates (for example including, but not limited to benzoate, 2-hydroxybenzoate, 2-aminobenzoate, benzenesulfonate, 2-hydroxybenzenesulfonate, 2-aminobenzenesulfonate), fatty acids and esters, fatty alcohols, and water-miscible solvents such as short chain alcohols. Examples of inorganic viscosity control agents are water-soluble ionizable salts. A wide variety of ionizable salts can be used. Examples of suitable salts are the halides and acetates of ammonium ion and the group IA and IIA metals of the Periodic Table of the Elements, for example, calcium chloride, lithium chloride. sodium chloride, potassium chloride, magnesium chloride, ammonium chloride, sodium bromide, potassium bromide, calcium bromide, magnesium bromide, ammonium bromide, sodium iodide, potassium iodide, calcium iodide, magnesium iodide, ammonium iodide, sodium acetate, potassium acetate, or mixtures thereof. Calcium chloride is preferred. The ionizable salts are particularly useful during the process of mixing the ingredients to make the compositions herein, and later to obtain the desired viscosity. The amount of ionizable salts used depends on the amount of active ingredients used in the compositions and can be adjusted according to the desire of the formulator. Typical levels of salts used to control the composition viscosity are from 0 to about 10%, preferably from about 0.01% to about 6%, and more preferably from about 0.02% to about 3% of the composition.

Viscosity modifiers or thickening agents can be added to increase the ability of the compositions to stably suspend water-insoluble articles, for example, perfume microcapsules. Such materials include hydroxypropyl substituted guar gum (such as that available from Rhône-Poulenc Corporation under the trade name JAGUAR HP200), polyethylene glycol (such as that available from Union Carbide Corporation under the trade name CARBOWAX 20M), hydrophobically modified hydroxyethylcellulose (such as that available from the Aqualon Company under the trade name NATROSOL Plus), and/or organophilic clays (for example, hectorite and/or bentonite clays such as those available from Rheox Company under the name BENTONE 27, 34 and 38 or from Southern Clay Products under the trade name BENTOLITE L; and those described in U.S. Pat. No. 4,103,047 to Zaki, et al., which is herein incorporated by reference). These viscosity raisers or thickeners can typically be used at levels from about 0.5% to about 30% by weight, preferably from about 1% to about 5%, more preferably from about 1.5% to about 3.5%, and further preferably from about 2% to about 3% by weight, of the composition.

Highly preferred materials of this class of thickeners and viscosity control and viscosity modifiers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Pearlizing and Opacifying Agents

Examples of pearlizing or opacifying agents that can be added to the compositions of the instant disclosure include, but are not restricted to, glycol distearate, propylene glycol distearate, and glycol stearate. Some of these products are available from Witco Corporation under the KEMESTER trade name.

Highly preferred materials of this class of pearlizing and opacifying agents are those that do bind to treated fabrics, nor cause any significant color change nor impart any discoloration, such as whitening, graying or yellowing, to the fabrics to which they are applied, either during treatment followed by drying and/or curing, or after the drying and/or curing step followed by normal exposure to the elements, such as air, moisture or sunlight exposure.

Antioxidants and Sunscreen Materials

Examples of antioxidants that can optionally be added to the compositions of the instant disclosure are propyl gallate, available from Eastman Chemical Products, Inc. under the trade names TENOX PG and TENOX S-1, and dibutylated hydroxytoluene, available from UOP Inc. under the trade name SUSTANE BHT. Also preferred are antioxidants for providing sun-fade protection for textiles treated with the fabric treatment compositions of the instant disclosure, such antioxidants being described in EP0773982, and incorporated herein by reference. Preferred antioxidants include 2-(N-methyl-Ncocoamino)ethyl-3',5'-di-tert-butyl-4'-hydroxybenzoate; 2-(N, N-dimethyl-amino)ethyl-3',5'-di-tert-butyl-4'-hydroxybenzoate; 2-(N-methyl-N-cocoamino) ethyl-3',4',5'-trihydroxybenzoate; and mixtures thereof, more preferably 2-(N-methyl-N-cocoamino)ethyl-3',5'-di-tert-butyl-4'-hydroxy benzoate. Of these compounds, the butylated derivatives are preferred in the compositions disclosed herein, because tri-hydroxybenzoates have a tendency to discolor upon exposure to light. The antioxidant compounds of the instant disclosure demonstrate light stability in the fabric treatment compositions discussed herein. "Light stable" as used herein is understood to mean that the antioxidant compounds used in the fabric treatment compositions disclosed herein do not discolor when exposed to either sunlight or simulated sunlight for approximately 2 to 60 hours at a temperature of from about 25° C. to about 45° C. Antioxidant compounds and free radical scavengers can generally protect dyes from degradation by first preventing the generation of single oxygen and peroxy radicals, and thereafter terminating the degradation pathways. Not to be limited by theory, a general discussion of the mode of action for antioxidants and free radical scavengers is disclosed in Kirk-Othmer Encyclopedia of Chemical Technology, Volume 3, pages 128-148, Third Edition (1978) which is incorporated herein by reference.

Compositions of the instant disclosure may comprise an organic sunscreen. Suitable sunscreens can have UVA absorbing properties, UVB absorbing properties, or a combination of both. The compositions of the present disclosure may preferably comprise a UVA absorbing sunscreen actives that absorb UV radiation having a wavelength from about 320 nm to about 400 nm. Suitable UVA absorbing sunscreen actives include dibenzoylmethane derivatives, anthranilate derivatives such as methylanthranilate and homomethyl-1-N-acetylanthranilate, and mixtures thereof. Examples of dibenzoylmethane sunscreen actives are described in U.S. Pat. No. 4,387,089 to De Polo; and in Sunscreens: Development, Evaluation, and Regulatory Aspects edited by N. J. Lowe and N. A. Shaath, Marcel Dekker, Inc. (1990), which are incorporated herein by reference. The UVA absorbing sunscreen active is preferably present in an amount to provide broad-spectrum UVA protection either independently, or in combination with, other UV protective actives that may be present in the composition. Preferred UVA sunscreen actives include dibenzoylmethane sunscreen actives and their derivatives. They include, but are not limited to, those selected from 2-methyldibenzoylmethane, 4-methyldibenzoylmethane, 4-isopropyldibenzoylmethane, 4-tert-butyldibenzoylmethane, 2,4-dimethyldibenzoylmethane, 2,5-dimethyldibenzoylmethane, 4,4'-diisopropylbenzoylmethane, 4-(1,1-dimethylethyl)-4'-methoxydibenzoylmethane, 2-methyl-5-isopropyl-4'-methoxydibenzoylmethane, 2-methyl-5-tert-butyl-4'-methoxydibenzoylmethane, 2,4-dimethyl-4'-methoxydibenzoylmethane, 2,6-dimethyl-4'-tert-butyl-4'-methoxydibenzoylmethane, and mixtures thereof. Preferred dibenzoyl sunscreen actives include those selected from 4-(1,1-dimethylethyl)-4'-methoxydibenzoylmethane, 4-isopropyldibenzoylmethane, and mixtures thereof. A more preferred sunscreen active is 4-(1,1-dimethylethyl)-4'-methoxydibenzoylmethane, which is also known as butylethoxydibenzoylmethane or Avobenzone, is commercially available under the names of PARSOL 1789 from Givaudan Roure (International) S. A. (Basel, Switzerland) and EUSOLEX 9020 from Merck & Co., Inc. (Whitehouse Station, N.J.). The sunscreen 4-isopropyldibenzoylmethane, which is also known as isopropyldibenzoylmethane, is commercially available from Merck under the name of EUSOLEX 8020. The fabric treatment compositions disclosed herein may preferably further comprise a UVB sunscreen active that absorbs UV radiation having a wavelength of from about 290 nm to about 320 nm. The compositions may preferably comprise an amount of the UVB sunscreen active that is safe and effective to provide UVB protection either independently, or in combination with, other UV protective actives that may be present in the compositions. The compositions preferably comprise from about 0.1% to about 16%, more preferably from about 0.1% to about 12%, and further preferably from about 0.5% to about 8% by weight, of UVB absorbing organic sunscreen. A wide variety of UVB sunscreen actives are suitable for use herein. Non-limiting examples of such organic sunscreen actives are described in U.S. Pat. No. 5,087,372 to Toyomot and U.S. Pat. Nos. 5,073,371 and 5,073,372 both to Turner, et al., which are incorporated herein by reference. Preferred UVB sunscreen actives are selected from 2-ethylhexyl-2-cyano-3,3-diphenylacrylate (referred to as octocrylene), 2-phenyl-benzimidazole-5-sulphonic acid (PBSA), cinnamates and their derivatives such as 2-ethylhexyl-p-methoxycinnamate and octyl-p-methoxycinnamate, TEA salicylate, octyldimethyl PABA, camphor derivatives and their derivatives, and mixtures thereof. Preferred organic sunscreen actives include 2-ethylhexyl-2-cyano-3,3-diphenylacrylate (commonly named octocrylene), 2-phenyl-benzimidazole-5-sulphonic acid (PB SA), octyl-p-methoxycinnamate, and mixtures thereof. Salt and acid neutralized forms of the acidic sunscreens are also useful.

An agent may also be added to any of the compositions useful in the instant disclosure to stabilize the UVA sunscreen and to prevent it from photo-degrading on exposure to UW radiation and thereby maintaining its UVA protection efficacy. Wide ranges of compounds have been cited as providing these stabilizing properties and should be chosen to compliment both the UVA sunscreen and the composition as a whole. Suitable stabilizing agents include, but are not limited to, those described in U.S. Pat. No. 5,972,316 to Robinson; U.S. Pat. No. 5,968,485 to Robinson; U.S. Pat. No. 5,935,556 to Tanner, et al.; and U.S. Pat. No. 5,827,508 Tanner, et al., which are incorporated herein by reference. Preferred examples of stabilizing agents for use herein include 2-ethylhexyl-2-cyano-3,3-diphenylacrylate (referred to as octocrylene), ethyl-2-cyano-3,3-diphenylacrylate, 2-ethylhexyl-3,3-diphenylacrylate, ethyl-3,3-bis (4-methoxyphenyl)acrylate, and mixtures thereof.

Highly preferred materials of this class of antioxidants and sunscreen actives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

The compositions of the instant disclosure may preferably deposit from about 0.1 mg/g fabric to about 5 mg/g fabric of the sun-fade actives to reduce the sun fading of the fabric. Treatment of fabric with the fabric treatment compositions disclosed herein repeatedly may result in higher deposition levels, which contributes even further to the sun-fading protection benefit.

Dye Transfer Inhibitors and Dye Fixatives

The compositions disclosed herein can comprise from about 0.001% to about 20%, preferably from about 0.5% preferably to about 10%, and more preferably from about 1% to about 5% of one or more dye transfer inhibitors or dye fixing agents. The compositions and formulations disclosed herein can contain ethoxylated amines, amphoterics, betaines, polymers such as polyvinylpyrrolidone, and other ingredients that inhibit dye transfer. Optional dye fixing agents can be cationic, and based on quaternized nitrogen compounds or on nitrogen compounds having a strong cationic charge which is formed in situ under the conditions of usage. Cationic fixatives are available under various trade names from several suppliers. Representative examples include: CROSCOLOR PMF (July 1981, Code No. 7894) and CROSCOLOR NOFF (January 1988, Code No. 8544) ex Crosfield; INDOSOL E50 (Feb. 27, 1984, Ref. No. 6008.35.84; polyethyleneamine-based) ex Sandoz; SANDOFIX TPS, ex Sandoz, is a preferred dye fixative for use herein. Additional non-limiting examples include SANDOFIX SWE (a cationic resinous compound) from Sandoz, REWIN SRF, REWIN SRF-O and REWIN DWR Crochet-Beitlich GMBH; Tinofix ECO, Tinofix FRD and Solvent from Ciba-Geigy. Other cationic dye fixing agents are described in "After treatments for Improving the Fastness of Dyes on Textile Fibres", Christopher C. Cook, Rev. Prog. Coloration, Vol. XH, (1982). Dye fixing agents suitable for use with the fabric treatment compositions discussed herein include ammonium compounds such as fatty acid-diamine condensates, inter alia, the hydrochloride, acetate, methosulphate and benzyl hydrochloride salts of diamine esters. Non-limiting examples include oleyldiethyl aminoethylamide, oleylmethyl diethylenediamine methosulphate, and monostearylethylene diaminotrimethylammonium methosulphate. In addition, the N-oxides of tertiary amines; derivatives of polymeric alkyldiamines, polyamine-cyanuric chloride condensates; and aminated glycerol dichlorohydrins are suitable for use as dye fixatives in the fabric treatment compositions of the instant disclosure.

Highly preferred materials of this class of dye transfer inhibitors and dye fixatives are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Chlorine Scavengers

The fabric treatment compositions discussed herein may optionally comprise from about 0.01%, preferably from about 0.02%, more preferably from about 0.25% to about 15%, further preferably to about 10%, and yet more preferably to about 5% of a chlorine scavenger. In cases wherein the cation portion and the anion portion of the non-polymeric scavenger each react with chlorine, the amount of scavenger can be adjusted to fit the needs of the formulator. Suitable chlorine scavengers include ammonium salts having the formula: $[(R)_3R'N]X$ wherein each R is independently hydrogen, $C_1$-$C_4$ alkyl, —$C_1$-$C_4$ substituted alkyl, and mixtures thereof; preferably R is hydrogen or methyl, more preferably hydrogen; R' is hydrogen $C_1$-$C_{10}$ alkyl, $C_1$-$C_{10}$ substituted alkyl, and mixtures thereof. Preferably R is hydrogen and X is a compatible anion. Non-limiting examples include chloride, bromide, citrate, and sulfate; preferably X is chloride. Non-limiting examples of preferred chlorine scavengers include ammonium chloride, ammonium sulfate, and mixtures thereof, preferably ammonium chloride. Other chlorine scavengers include reducing agents such as thiosulfate.

Highly preferred materials of this class of chlorine scavengers are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Wetting Agents

The compounds disclosed herein may contain from about 0.005% to about 3.0%, and more preferably from about 0.03% to 1.0% of a wetting agent. Such wetting agents may be selected from polyhydroxy compounds. Examples of water soluble polyhydroxy compounds that can be used as wetting agents in the fabric treatment compositions discussed herein include glycerol, polyglycerols having a weight-average molecular weight from about 150 to about 800, and polyoxyethylene glycols and polyoxypropylene glycols having a weight-average molecular weight from about 200 to about 4000, preferably from about 200 to about 1000, and more preferably from about 200 to about 600. Polyoxyethylene glycols having a weight-average molecular weight from about 200 to about 600 are especially preferred. Mixtures of the above-described polyhydroxy compounds may also be used. A particularly preferred polyhydroxy compound is polyoxyethylene glycol having a weight-average molecular weight of about 400, available from Union Carbide Corporation under the trade name PEG-400.

Highly preferred materials of this class of wetting agents are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Electrolytes

Suitable inorganic salts for use as an optional electrolyte in the present compositions include $MgI_2$, $MgBr_2$, $MgCl_2$, $Mg(NO_3)_2$, $Mg_3(PO_4)_2$, $Mg_2P_2O_7$, $MgSO_4$, magnesium silicate, NaI, NaBr, NaCl, NaF, $Na_3PO_4$, $Na_2SO_3$, $Na_2SO_4$, $NaNO_3$, $Na_4P_2O_5$, sodium silicate, sodium metasilicate, sodium tetrachloroaluminate, sodium tripolyphosphate (STPP), Na2S3O7, sodium zirconate, $CaF_2$, $CaCl_2$, $CaBr_2$, $CaI_2$, $CaSO_4$, $Ca(NO_3)_2$, KI, KBr, KCl, KF, $KNO_3$, $KIO_3$, $K_2SO_4$, $K_2SO_3$, $K_3PO_4$, $K_4(P_2O_7)$, potassium pyrosulfate, potassium pyrosulfite, LiI, LiBr, LiCl, LiF, $LiNO_3$, $AlF_3$, $AlCl_3$, $AlBr_3$, $AlI_3$, $Al_2(SO_4)_3$, $Al(PO_4)$, $Al(NO_3)_3$, aluminum silicate; including hydrates of these salts and including combinations of these salts or salts with mixed cations e.g. potassium aluminum $AlK(SO_4)_2$ and salts with mixed anions, e.g. potassium tetrachloroaluminate and sodium tetrafluoroaluminate. Salts incorporating cations from groups Illa, IVa, Va, Vla, VIIa, VIII, Ib, and IIb on the periodic chart with atomic numbers greater than are also useful in reducing dilution viscosity but less preferred due to their tendency to change oxidation states and thus they can adversely affect the odor or color of the formulation or lower weight efficiency. Salts with cations from group Ia or IIa with atomic numbers greater than 20 as well as salts with cations from the lanthanide or actinide series are useful in reducing dilution viscosity, but less preferred due to lower weight efficiency or toxicity. Mixtures of above salts are also useful.

Also preferred are quaternary ammonium salts, quaternary alkyl ammonium salts, quaternary dialkyl ammonium salts, quaternary trialkyl ammonium salts and quaternary tetraalkyl ammonium salts wherein the alkyl substituent comprises a methyl, ethyl, propyl, butyl or higher $C_5$-$C_{12}$ linear alkane radical, or combinations thereof. Organic salts useful herein include, magnesium, sodium, lithium, potassium, zinc, and aluminum salts of the carboxylic acids including formate, acetate, proprionate, pelargonate, citrate, gluconate, lactate, aromatic acids e.g. benzoates, phenolate and substituted benzoates or phenolates, such as phenolate, salicylate, polyaromatic acids terephthalates, and polyacids e.g. oxylate, adipate, succinate, benzenedicarboxylate, benzenetricarboxylate. Other useful organic salts include carbonate and/or hydrogen carbonate ($HCO_3^{-1}$) when the pH is suitable, alkyl and aromatic sulfates and sulfonates, e.g., sodium methyl sulfate, benzene sulfonates and derivatives such as xylene sulfonate, and amino acids when the pH is suitable.

Electrolytes can comprise mixed salts of the above, salts neutralized with mixed cations such as potassium/sodium tartrate, partially neutralized salts such as sodium hydrogen tartrate or potassium hydrogen phthalate, and salts comprising one cation with mixed anions.

Highly preferred materials of this class of inorganic and organic electrolytes are those that do not cause any significant color change, nor impart any discoloration, such as graying or yellowing, to the fabrics to which they are applied, either during treatment followed by drying and/or curing, rafter the drying and/or curing step followed by normal exposure to the elements, such as air, moisture or sunlight exposure.

Generally, inorganic electrolytes are preferred over organic electrolytes for better weight efficiency and lower costs. Mixtures of inorganic and organic salts can be used. Typical levels of electrolyte in the present compositions can be less than about 10%, preferably from about 0.5% to about 5%, more preferably from about 0.75% to about 2.5%, and further preferably from about 1% to about 2% of the inventive composition.

Enzymes

Additional desirable adjuncts may be enzymes (although it may be preferred to also include an enzyme stabilizer), including, but not limited to hydrolases, hydroxylases, cellulases, peroxidases, laccases, mannases, amylases, lipases and proteases. Proteases are one especially preferred class of enzymes. Typical examples of proteases include Maxatase and Maxacal from Genencor International, Alcalase, Savinase, and Esperase, all available from Novozymes North America, Inc. See also U.S. Pat. No. 4,511,490 to Stanislowski, et al., incorporated herein by reference. Further suitable enzymes are amylases, which are carbohydrate-hydrolyzing enzymes. It may also be preferred to include mixtures of amylases and proteases. Suitable amylases include Termamyl from Novozymes, North America Inc, and Maxamyl from Genencor International Co. Still other suitable enzymes are cellulases, such as those described in U.S. Pat. No. 4,479,881 to Tai; U.S. Pat. No. 4,443,355 to Murata, et al.; U.S. Pat. No. 4,435,307 to Barbesgaard, et al.; and U.S. Pat. No. 3,983,082 to Ohya, et al., incorporated herein by reference. Yet other suitable enzymes are lipases, such as those described in U.S. Pat. No. 3,950,277 to Silver; U.S. Pat. No. 4,707,291 to Thorn, et al.; U.S. Pat. Nos. 5,296,161 and 5,030,240 both to Wiersema, et al.; and U.S. Pat. No. 5,108,457 to Poulose, et al., incorporated herein by reference. The hydrolytic enzyme may be present in an amount of about 0.01-5%, more preferably about 0.01-3%, and further preferably about 0.1-2% by weight of the detergent. Mixtures of any of the foregoing hydrolases are desirable, especially protease/amylase blends.

Highly preferred materials of this class of enzymes are those that do not cause any significant residual odor or color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Bleaching Agents

The fabric treatment compositions of the instant disclosure may optionally comprise from about 0.01%, preferably from about 0.02%, more preferably from about 0.25% to about 15%, further preferably to about 10%, and yet more preferably to about 5% of a bleaching agent. Suitable bleaching agents include chlorine-releasing agents and peroxygen and peroxide-releasing compounds. Alkali metal hypochlorites, including sodium or potassium hypochlorite, are preferred chlorine releasing agents. Peroxygen compounds include alkali metal salts of percarbonate, perborate and peroxymonosulfate. Peroxide compounds, including hydrogen peroxide and compounds generating hydrogen peroxide in solution, peroxyacids and precursors to peroxyacids and peroxyimidic acids, and metal based oxidants are also suitable. Suitable bleaching agents include preformed peracids and organic peroxides, including alkonyl and acyl peroxides such as tertiary butyl peroxide and benzoyl peroxide, and related alkonyl and acyl peroxide and superoxide derivatives of alkyls and arenes. Additionally, an appropriate bleach activator for the active oxygen source or peroxide may be present, such those found in Arbogast, et al., U.S. Pat. Nos. 5,739,327 and 5,741,437; Alvarez, et al.; U.S. Pat. No. 5,814,242, Deline, et al.; U.S. Pat. Nos. 5,877,315; and 5,888,419 to Casella, et al., which relate to cyanonitrile derivatives; U.S. Pat. Nos. 4,959,187 and 4,778,816 to Fong, et al.; U.S. Pat. Nos. 5,112,514 and 5,002,691 to Bolkan, et al., and U.S. Pat. No. 5,269,962 to and Brodbeck, et al., which relate to alkanoyloxyacetyl derivatives; and U.S. Pat. Nos. 5,234,616, 5,130,045 and 5,130,044 to Mitchell, et al., all of which relate to alkanoyloxyphenyl sulfonates; all of which are incorporated herein by reference.

Highly preferred materials of this class of bleaching agents are those that do not cause any significant fabric damage or color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

Brighteners

Optical brighteners, also referred to as fluorescent whitening agents or FWAs, have long been used to impart whitening to fabrics during the laundering process. These fluorescent materials act by absorbing ultraviolet wavelength of light and emitting visible light, generally in the color blue wavelength ranges. The FWAs settle out or deposit onto fabrics during the wash cycle. These include the stilbene, styrene, and naphthalene derivatives, which upon being impinged by ultraviolet light, emit or fluoresce light in the visible wavelength. These FWAs or brighteners are useful for improving the appearance of fabrics, which have become dingy through repeated sailings and washings. Due to the cationic nature of the composition, it is preferred that the FWAs not be explicitly anionic but rather either nonionic; cationic: amphoteric: or neutralized, ion-paired moieties of anionic FWAs as described in Petrin, et al., U.S. Pat.

No. 5,057,236. Preferred anionic FWAs for ion-pairing according to Petrin, et al, '236 are Blankophor BBH, RKH and BHC, from Blankophor GmbH & Co. KG; and Tinopal 5BMX-C, CBS-X and RBS, from BASF. Fluorescent whiteners most currently used in common laundry compositions generally fall into a category referred to in the art as diaminostilbene disulfonic acid-cyanuric chloride brighteners or DASC-brighteners. These compounds have the following general formula (I):

(I)

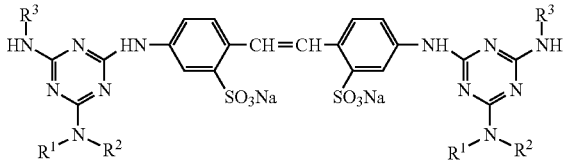

Examples of such DASC fluorescent whiteners include those sold by the Ciba-Geigy Corporation under the trade name "Tinopal", which are substituted stilbene 2,2'-disulfonic acid products, e.g., disodium 4,4'-bis-((4-anilino-6-morpholino-1,3,5-triazin-2-yl) amino)stilbene-2,2'-disulfonate (sold as Tinopal AMS); disodium 4,4'-bis-((4-anilino-6-(N-2-hydroxyethyl-N-methyl amino)-1,3,5-triazin-2-yl)amino) stilbene-2,2'-disulfonate (sold as Tinopal 5BM); disodium 4,4'bis-((4-anilino-6-(bis(2-hydroxyethyl)amino)-1,3,5-triazin-2-yl) amino)stilbene-2,2'-disulfonate (sold as Tinopal UNPA). Another example sold by Bayer Corporation is disodium 4,4'-bis-((4-anilino-6-methylamino)-1,3,5-triazin-2-yl) amino)-stilbene-2,2'-disulfonate (sold as Phorwite HRS).

Examples of suitable FWAs can be found in U.K. Patent Nos. 1,298,577; 2,076,011; 2,026,054; 2,026,566; 1,393,042; and 3,951,960 to Heath, et al., U.S. Pat. No. 4,298,290 to Barnes, et al., U.S. Pat. No. 3,993,659 to Meyer, U.S. Pat. No. 3,980,713 to Matsunaga, et al., and U.S. Pat. No. 3,627,758 to Weber, et al., incorporated herein by reference. See also, U.S. Pat. No. 4,900,468 to Mitchell, et al., column 5, line 66 to column 6, line 27, incorporated herein by reference.

As stated above, most preferred are cationic, nonionic, and amphoteric FWAs, such as those cited in U.S. Pat. Nos. 4,433,975, 4,432,886, 4,384,121, all to Meyer and U.S. Pat. No. 4,263,431 to Weber, et al., and incorporated herein by reference. Further examples of suitable FWAs are described in McCutcheon's Vol. 2: Functional Materials, North American Ed., McCutcheon Division, MC Publishing Co., 1995, and Encyclopedia of Chemical Technology, 11th volume, John Wiley & Sons, 1994, both of which are incorporated herein by reference. Other examples of fluorescent brightening materials suitable for use herein may be found in U.S. Pat. No. 6,251,303 to Bawendi, et al.; U.S. Pat. No. 6,127,549 to Hao, et al.; U.S. Pat. No. 6,133,215 to Zeiger, et al.; U.S. Pat. No. 6,117,189 to Reinehr, et al.; U.S. Pat. No. 6,120,704 to Martini; and U.S. Pat. No. 6,162,869 to Sharma, et al., incorporated herein by reference.

Highly preferred materials of this class of brighteners are those that do not cause any significant color change, nor impart any discoloration, such as graying or yellowing, to the fabrics to which they are applied, either during treatment followed by drying and/or curing, or after the drying and/or curing step followed by normal exposure to the elements, such as air, moisture or sunlight exposure.

In selecting the various components for the fabric treatment composition, most preferred are those that do not cause any significant damage to treated fabrics or cause any significant color change, nor impart any discoloration, such as whitening, graying or yellowing, to the fabrics to which they are applied, either during treatment followed by curing and/or drying, or after the curing and/or drying step followed by normal exposure to the elements, such as air, moisture or sunlight exposure. In particular, dye and colorants should not undergo any significant change from their original color and not stain or discolor the fabrics to which they are applied. Finally, bleaching agents should also not interfere with the function of stain release and/or fabric treatment.

Formulation

The fabric treatment compositions of the present disclosure and/or products incorporating the compositions may be in any form known to those skilled in the art. For example, the compositions and/or products may be in the form of an aerosol, liquid, granular, powder, tablet, solid, paste, foam and/or bar compositional form, or their encapsulated or coated forms. These compositions and/or products may be neat or releasably absorbed or adsorbed on to a substrate, such as a woven or non-woven filament substrate or packaged within a suitable article of manufacture for convenient handling and dispensing. In this aspect of the instant disclosure, an article of manufacture maybe provided that comprises the inventive composition and a spray dispensing device, an aerosol dispensing device, a standard bottle, a device to release the composition into the rinse water, or a water soluble or water-insoluble sachet or package, or a water soluble or water-insoluble tablet or powder which enables release of the composition. A suitable film coating or encapsulate may also be employed with either a liquid or solid form to provide for release of the composition.

The spray dispenser can be any of the manually activated means for producing a spray of liquid droplets as is known in the art, e.g., trigger-type, pump-type, electrostatic spray device, non-aerosol self-pressurized, and aerosol-type spray devices. Regardless of the specific spray means employed, it is preferred that at least about 70%, more preferably, at least about 80%, and further preferably at least about 90% of the droplets have a particle size smaller than about 200 microns. Generally in instances where the potential for inhalation by users may occur, it is most preferred that at least about 70%, more preferably, at least about 80%, and further preferably at least about 90% of the droplets have a particle size larger than about 5 microns.

Suitable trigger-type and pump-type spray devices are disclosed in U.S. Pat. No. 4,161,288 to McKinney; U.S. Pat. No. 4,558,821 to Tada, et al.; U.S. Pat. No. 4,434,917 to Saito, et al; and U.S. Pat. No. 4,819,835 to Tasaki, all of said patents being incorporated herein by reference. Particularly preferred to be used herein are spray-type dispensers, such as T 8500 commercially available from Continental Spray International, or other manufactures commonly known in the trade. In such a dispenser, the liquid composition can be divided in fine liquid droplets resulting in a spray that is directed onto the fabric surface to be treated. Suitably fine droplet sizes are achieved in such spray-type dispensers owing to the mechanism of operation in which the composition contained in the body of the dispenser is directed through the spray-type dispenser bead via energy communicated to a pumping mechanism by the user as the composition is forced against an obstacle, such as a screen grid or a cone or the like, which provides sufficient shock to the stream of the ejected liquid composition to atomize the liquid composition and provide the formation of liquid droplets of sufficiently small size.

Preferably, the aerosol-dispensing device of the instant disclosure can be any of the manually activated devices employing a pressurized propellant as known in the art. The aerosol dispenser may comprise a container, which can be constructed of any of the conventional materials employed in fabricating aerosol containers. The dispenser should be capable of withstanding internal pressure in the range of about 20 to about 120 psig, and preferably from about 20 to about 80 psig. An important characteristic concerning the dispenser is that it be provided with a valve member, which can permit the fabric treatment composition disclosed herein to be dispensed in the form of a spray of very fine, or finely divided, particles or droplets. The aerosol dispenser utilizes a pressurized sealed container from which the composition of the present disclosure can be dispensed through a special actuator/valve assembly under pressure. The aerosol dispenser is pressurized by incorporating therein a gaseous component generally known as a propellant. Common aerosol propellants, e.g., gaseous hydrocarbons such as isobutane, mixed halogenated hydrocarbons, compressed air, nitrogen, inert gases, and carbon dioxide, are suitable. Highly preferred are those propellants that do not present environmental concerns, such as compressed air, nitrogen, inert gases and carbon dioxide. A more complete description of commercially available aerosol-spray dispensers appears in U.S. Pat. No. 3,436,772, to Stebbins and U.S. Pat. No. 3,600,325 to Kaufman, et al., which are incorporated herein by reference.

The spray dispenser can be a self-pressurized non-aerosol container having a convoluted liner and an elastomeric sleeve. The self-pressurized dispenser can be comprised of an assembly containing a liner and a sleeve comprising a thin, flexible radially expandable convoluted plastic liner of about 0.010 (0.25 mm) to about 0.020 (0.50 mm) inch thick, inside an essentially cylindrical elastomeric sleeve. The liner and sleeve assembly can be capable of holding a substantial quantity of the composition of the instant disclosure and of causing the product to be dispensed. A description of such self-pressurized spray dispensers can be found in U.S. Pat. No. 5,111,971 to Winer and U.S. Pat. No. 5,232,126 to Winer, which are incorporated herein by reference. Another suitable type of aerosol spray dispenser is one in which a barrier membrane separates a composition from the propellant, as is disclosed in U.S. Pat. No. 4,260,110 to Werding, which is incorporated herein by reference. Such a dispenser is available from EP Spray Systems, East Hanover, N.J.

Fabric treatment compositions such as those disclosed herein can be introduced into an automatic washing machine prior to or during the main wash cycle of the machine in any suitable form as described herein. Some commercial washing machines provide a presoaking cycle into which compositions of the present disclosure can be introduced. The presoaking or soaking cycle generally provides for treatment of clothing prior to introduction of a detergent or other additives prior to the main wash cycle. The compositions disclosed herein may be employed alone as a sole treatment and may be employed in combination with other laundry additive products, such as liquid or powdered detergents, laundry additives or laundry booster products that are commonly in use. Additionally, the fabric treatment compositions disclosed herein can be introduced subsequent to a detergent using a delayed release packaging material or device or similar means. Some commercial washing machines, for example, provide a means to automatically dispense an additive to the main wash water (the "wash liquor") after a short delay following the initiation of a wash cycle. Other "drop in" dosing and dispensing devices known to the art can also be employed for releasing the inventive compositions into the main wash cycle. Delayed release packaging can also be employed to hold and subsequently release the compositions of the present disclosure at a predetermined time during the wash cycle. When such delayed release packaging material is employed, it is desirable for the release of the compositions disclosed herein to be delayed in such a manner that sufficient time remains within the cycle time of the wash for the fabric treatment composition to act upon the clothing in order to provide effective treatment thereupon. All of these approaches provide a means to treat articles, for example textiles, clothing, garments and the like, according to the methods disclosed herein. Also suitable are methods in which articles are treated with the compositions and methods of the instant disclosure in an aqueous liquor, such as when washing by hand, washing in a tub, bucket or sink, as is commonly done with individual, so-called delicate articles and fine items of clothing and textiles that are not typically machine washed.

It is also envisioned that the compositions can be formulated so as to assume the primary role of detergent in addition to imparting stain and soil resistance. Such compositions are especially preferred, in that in practice the consumer needs to purchase and use only a single all-in-one product, which imparts cleaning, stain and soil resistance. In such a case, the composition used according to the methods disclosed herein would preferably be formulated to include optional adjuncts such as surfactants, builders, fluorescent whitening agents, enzymes, and the like in appropriate levels to achieve the desired cleaning effect without having any effective impact on the hydrophobic agent, the zeta potential modifier or the optional fluoropolymer of the instant disclosure in regards to the inventive method for imparting stain and soil resistance to the desired materials. Considerations enumerated above, especially careful adjustment of zeta potential modifier so that the wash liquor exhibits zeta potential greater than zero, result in compositions that are effective in cleaning, as well as in imparting stain and soil resistance as achieved by the methods disclosed herein.

Fabric treatment compositions of the instant disclosure can be introduced into an automatic washing machine during the rinse cycle of the machine using rinse water additive dispensers that are well known in the art. Examples include U.S. Pat. No. 5,768,918 to McKibben; U.S. Pat. No. 5,267,671 to Baginski, et al.; U.S. Pat. No. 4,835,804 to Arnau-Munoz, et al.; U.S. Pat. No. 3,888,391 to Merz; and U.S. Pat. No. 3,108,722 to Torongo, Jr., et al. Centrifugal force applied to a weight inside the dispenser during a spin cycle of an automatic clothes washer can cause a dispenser valve to become unseated so that additive from the dispenser may spill out of the dispenser and mix with rinse water that is added to the washer after the spin cycle. The dispenser can be normally inserted into the washer before the wash cycle begins. It should remain closed during the agitation of the wash cycle, yet reliably open during the first spin cycle at the conclusion of the wash cycle in order to deliver the composition of the instant disclosure at a point in time at which it will be most effective.

Compositions of the present disclosure may be packaged in sachet form for convenient dosing and handling by the user. The sachet may be of any suitable shape and construction. Highly convenient shapes from the viewpoints of both manufacture and packing are square and rectangular, but any other desired shape is also suitable.

Preferred sachets may contain one, two, or more compartments. In a two-compartment sachet, the compartments may, for example, be side-by-side, joined by a common seal, or back-to-back, joined by a common wall. The former arrangement is more suitable if the two compartments are to be very different in size, and is also easier to make. Other multi-compartment arrangements are disclosed in EP 236136A, which is incorporated herein by reference. The relative sizes of a single or multi-compartment sachet can be tailored to match the proportions of the total contents to be accommodated in each, and the optimum shape of the sachet chosen accordingly. For example, a single compartment or first compartment of a two-compartment sachet can contain a relatively larger dosage of the composition of the current disclosure for first treatment purposes, while the second compartment of a two-compartment sachet can contain a relatively smaller dosage for second or subsequent treatments, e.g., maintenance treatment purposes. The individual compartments of a two or multi-compartment sachet can be easily separated from one another by the user for dosage control when the contents comprise the same composition, enabling one, two or multiple compartments of the sachet to be used simultaneously, depending on the quantity of composition required. The second compartment of a two-compartment sachet may also contain ingredients other than the fabric treatment compositions disclosed herein such as typical adjuncts, e.g., other non-interfering ingredients being packed together with the composition of the current disclosure to provide a secondary benefit. The total amount of a composition of the current disclosure to be packaged in the sachet product may vary, for example, from 10 to 150 g for a half dose (20 to 300 g for a single dose), depending on the type and size of washing machine in which it is intended to be used, and the amount of fabric that is intended to be treated. It is generally preferred that the sachet system be designed such that the contents will be released at or very shortly after the time of addition to the wash liquor or the rinse water (the "rinse liquor"), depending upon which cycle of the wash the sachet containing the composition is added.

In an alternate embodiment, substantially complete delivery of the contents is delayed to occur after at most 30 minutes, and more preferably at most 25 minutes from the time of addition to the wash liquor so that the contents of the sachet, which is introduced during the wash cycle of the washing machine, are not substantially released until at least the beginning of the rinse cycle of the washing machine. In this latter embodiment, it may be sometimes be desirable for the sachet systems to be designed such that at least one compartment or sachet thereof gives a delayed or controlled release of the contents. Suitable sachet structures are described in EP236136A, Anderson, et al., which is incorporated herein by reference.

In another embodiment, a water-insoluble sachet may be employed to hold the fabric treatment composition. Such a water-insoluble sachet for delivery of the composition may be of the closed, water-permeable type that relies on leaching out by the wash liquor for release of its contents. Alternatively, the sachet may be provided with a seal that will open under washing machine conditions, by the action of water or of mechanical agitation or both; for example, as disclosed in EP312277A, Newbold, et al., which is incorporated herein by reference. Opening sachets may be of either water-permeable or water-impermeable material, with water-permeable material being preferred. Suitable materials include paper, woven and non-woven fabrics, films of natural or synthetic origin, or combinations thereof having a base weight between 1 and 100 g/m2. Examples of these are disclosed, for example, in EP246897A, Newbold, et al., which is incorporated herein by reference, and include polyamide, polyester, polyacrylate, cellulose acetate, polyethylene, polyvinyl chloride, polypropylene, cellulosic fibers, regenerated cellulosic fibers, and mixtures thereof. Preferred materials include cellulose/polyester mix fabrics, and Manila/viscose non-woven paper. It is especially preferred that the seals are composed of a water-labile component and a heat-sealable component, as described in the before referenced EP246897A. These seals are sensitive at wash temperatures to the combination of water and mechanical agitation encountered in the washing machine environment, and open to release the sachet contents. It is preferable for the sachet substrate itself to be one that dis-solves or disintegrates in the wash or rinse liquor. Especially preferred are sachets of water-soluble film. Such film materials are well-known in the art and include polyvinyl alcohols and partially hydrolyzed polyvinyl acetates, alginates, cellulose ethers such as carboxymethylcellulose and methyl cellulose, polyacrylates, polyethylene oxide, and combinations of these.

Also within the scope of the present disclosure are essentially dry means of delivery of the compositions, including granular, powder and tablet forms of delivery, which may comprise the present composition and a suitable inert carrier in which the composition is reversibly compounded such that the composition can be effectively released to the water when the granular, powder or tablet delivery means is brought into contact with water, e.g., introduced into the wash water. In general, granular compositions in accordance with the present disclosure can be made via a variety of methods including dry mixing, spray drying, agglomeration and granulation. Tablets suitable for delivery of the fabric treatment compositions disclosed herein are well known in the art. Preferred are tablets of a size that are convenient for dosing in a washing machine. A preferred size is from 5 g to 200 g, more preferably from 5 g to 100 g, and the size can be selected in accordance with the intended wash load and the design of the washing machine, which is to be used. Also suitable are tablets containing two or more compositional zones, in which one zone may comprise materials of the present disclosure and a second zone may comprise a carrier comprising, but not limited to, adjunct materials described herein as suitable optional additives.

Methodology

As further described herein, fabric treatment compositions disclosed herein can be deposited onto fabrics by a number of methods. Regardless of the technique employed, the critical feature is that the hydrophobic agent and fluoropolymer become deposited on the fabric surface. Subsequent heating above ambient temperatures but below 100° C., preferably below 70° C., reversibly cures the composition onto the fabric. However, excessive heating above 100° C. is to be avoided, as the resulting coating is then bound to the fabric too tenaciously, leading to decreased overall performance of the coating. Without being bound by theory, it is believed that the coating should be reversibly bound to effect release of stains and soils during subsequent laundering of the fabric.

As described in U.S. Pat. No. 7,893,014 to van Buskirk, et al., and in co-pending application U.S. Ser. No. 14/549,555, to van Buskirk, et al., the use of fabric treatment compositions similar to those described herein includes introducing the composition during home laundering of soiled garments in traditional home washing machines that have a 25 to 90 liter capacity when filled. Such machines typically have a fill or wash cycle of about 12 to 18 minutes' duration, during which time the initial volume of water is added, followed by a rinse cycle of about 2 to 5 minutes, during which time sufficient water is added to disperse the soil, detergent, and any other laundry additives. The rinse cycle, in turn, is typically followed by a spin cycle of about 10 to 20 minutes. The user of such traditional washing machines had the flexibility of using higher doses of the formulations described herein for larger loads, as well as pausing a cycle to allow for greater deposition of fabric-treatment actives. Between the wash, rinse and spin cycles, the introduced water is drained.

With "high-efficiency washing machines" or "HE washers," it was noted earlier that such washing machines are designed to be more efficient that traditional washing machines in both their energy consumption and water use. As is widely acknowledged, "[c]ompared to traditional washers, HE washers work in a completely different way." See American Cleaning Institute, "*High Efficiency Washers and Detergents*", Washington D.C., 2010, mentioned above. Whereas traditional washers completely submerge laundry in water and have an agitator that moves the laundry back and forth to loosen soils, most HE washers use a "tumbler" system with no agitator. Because the new systems are designed to be so efficient, HE washers can use low-water wash and rinse cycles. In many models the laundry is washed in a shallow pool of water; while in other models, the water level is so low that a pool of water may not be observed. As a result, HE washers use less water than traditional washers. In fact, HE washers typically only use from 20% to 66% of the water used by traditional agitator washers. As a result, energy use can be as little as 20 to 50% of the energy used by traditional agitator washers because there is much less water to heat.

It should also be noted that while traditional washing machines also provide the opportunity for the user to dose in as much laundry product "over the side", that is directly into the wash or rinse liquor, while HE washers have dosing compartments of fixed volume into which the laundry product can be filled. As such, it is advantageous to have the instant fabric treatment formulations concentrated enough to be dosed into the fabric softener compartment without being prematurely siphoned directly into the washer, preferably less than 150 mL per dose, more preferably less than 100 mL per dose, and most preferably less than 85 mL per dose. Further, while traditional washing machines provided the opportunity to pause the machine in the middle of the treatment cycle to allow enhanced deposition, HE washers often do not allow the machine to be paused in the middle of a treatment cycle. Even if they do allow the machine to be paused, the lack of immersion of clothing into the rinse liquor would result in uneven deposition. Therefore the time of exposing the fabrics to compositions disclosed herein must be efficiently executed within a period of no more than 10 minutes, preferably less than 5 minutes, and most preferably less than 3 minutes.

When detergent is used, the inventive fabric treatment composition preferably includes at least one zeta potential modifier. In one embodiment, a fabric treatment composition containing a fluoropolymer, hydrophobic agent, and zeta potential modifier is added to a fabric any time during the wash cycle, that is, the period in which a detergent is added during the overall laundering process. Alternatively, the fabric treatment composition may be added whenever a fabric softener is added to the washing machine, as during a rinse cycle.

If desired, according to an embodiment, a laundry product may be formulated that includes a detergent in addition to the hydrophobic agent, fluoropolymer and zeta potential modifier of the instant fabric treatment compositions, to provide a method for imparting stain and soil resistance to a fabric. Such a formulated product may also contain additional adjuncts such as surfactants, builders, fluorescent whitening agents, enzymes and the like. Such adjuncts should be selected such they have minimal impact on the active ingredients that impart fabric protective properties such as stain and soil resistance. Such a formulated composition can be added during the initial fill/wash cycle of a washing machine in which the cleaning and protective methods discussed herein may be practiced. This method is especially preferred, as the consumer does not need to further intervene during the automated laundering process.

An effective amount of the fabric treatment compositions disclosed herein can be sprayed or applied directly onto fabrics, particularly clothing. When the composition is sprayed or applied directly onto a fabric, an effective amount that can be deposited onto the fabric without causing saturation of the fabric is typically from about 10 to about 85 weight %, preferably from about 15 to about 65 wt. %, and more preferably from about 20 to about 50 wt. % of the fabric. The amount of active that can be typically sprayed or applied directly onto the fabric is from about 0.1 to about 4 weight %, preferably from about 0.2 to about 3 weight %, and more preferably from about 0.3 to about 2 weight % of the fabric.

According to a method in alternate embodiment, a fabric treated with a fabric treatment composition described herein can be tumble-dried in a standard household clothes dryer and/or be ironed at normal ironing temperatures to effect curing of the fabric treatment composition onto the fabric. Inadvertent excessive curing or heating of a fabric that has been treated with the fabric treatment composition is to be avoided, especially where absorbency of the fabric is desired. Excessive heating of a treated fabric as during a drying or curing cycle could cause semi-permanent affixing of the treatment to the fabric. Accordingly, the temperature of the dryer should be set to a range of lower drying temperatures. Preferred drying temperatures that should be use to effect curing of the inventive fabric treatment compositions are less than 150° C., more preferably less than 125° C., even more preferably less than 100° C. and most preferably less than 70° C. For sensitive fabrics, drying temperatures less than about 70° C. are also preferred.

In yet another embodiment, treated fabrics can be allowed to dry at ambient temperature, and the curing effected subsequently by a post-dry heating in a standard clothes dryer and/or by ironing at temperatures preferably less than 150° C., more preferably less than 125° C. and even more preferably less than 100° C., and most preferably less than 70° C. Alternatively, the treated fabric can be subjected to radiant energy, such as from the sun, or infrared generating heat source, or exposure to microwave energy such as from a microwave dryer or microwave generating device, to effect curing of the applied fabric treatment composition. The treated fabric may simultaneously be dried and heated in one step to effect curing of the composition on the fabric, or these operations may optionally be conducted in sequence, providing that the heating step is performed subsequent to the drying step.

Similarly, an effective amount of the composition can be aerosolized and applied onto fabrics, particularly clothing, by means of a clothes revitalizing device, such as the Whirlpool PERSONAL VALET system distributed by the Whirlpool Corporation of Benton Harbor, Mich., or via a system that delivers a sprayed or aerosolized composition into the dryer itself. When used in such devices, the instant fabric treatment compositions can be combined with the revitalizing solution normally employed in the device, being combined in any desired ratio by volume, or substituted entirely in place of a revitalizing or other treatment solution in order to effect fabric treatment. An effective amount of the composition can be automatically metered and aerosolized to cause its deposition onto the clothes or textiles contained within the devices. A drying step subsequently performed by the revitalizing device equipped with an air blower and source of heat, or a source of heated air in the dryer automatically follows—or is simultaneous with—the deposition step in order to complete treatment of the fabrics contacted therein by the composition.

A textile can also be soaked in an effective amount of fabric treatment composition and then washed before tumble drying, ironing or tumble-drying with optional ironing. In this aspect of the disclosure, an acceptable method of delivery is to add the composition to a separate soak or treatment cycle performed in a washing machine or other suitable container with or without agitation, such as hand-soaking of fabrics performed in a sink, bucket or other such container, in which the composition of the present disclosure is added to water with sufficient agitation to uniformly mix the composition with the water to insure effective dispersal or dissolution of the composition to create a uniform dispersion or solution for subsequent treatment of the fabrics. The order of mixing can be in any order, that is, the composition can be added to water to effect dilution or water can be added to the composition to effect dilution after the composition is first introduced into a washing machine or other suitable container. Either way, it is preferable that the composition is first admixed with water to effect dilution before fabrics are exposed to the diluted composition, in order to effect the most uniform treatment possible. Subsequent agitation of the fabrics in the diluted composition is not generally required, although if preformed in a washing machine, such agitation is generally provided during the wash cycle. Some newer washing machines, however, provide for a timed soaking cycle with no agitation or with intermittent agitation. Following such treatments, fabrics can be drained of excess fluid and then dried at a temperature less than 100° C. or optionally ironed at appropriate heat settings. An available option is to rinse with fresh water and/or wash the soaked fabrics, followed by tumble drying below 100° C., preferably below 70° C., or optionally ironing at appropriate heat settings.

In a further aspect, an effective amount of the composition can be added to the standard wash cycle of an automatic washing machine and/or tumble-dried with optional ironing. It is also a further option to add the fabric treatment compositions described herein to the standard wash cycle and optionally rinse the fabrics prior to drying at less than 100° C., preferably less than 70° C., with optional ironing. Accordingly, the fabric treatment compositions described herein may be combined with any laundry additive, a detergent, completely substitute the detergent, or additional surfactant and builders added to replace the detergent. In still another aspect, an effective amount of the composition can be added to the standard rinse or separate part of the rinse cycle and/or tumble-dried with optional ironing. In this way, the fabric treatment composition may be combined with fabric softener or other rinse additive. When added to the wash or rinse cycle, a variety of addition devices may also be used. Many washing machines contain additive dispensers for laundry additives such as bleach or fabric softener. Other devices are known in the art to add liquids to the wash cycle and/or to release them into the rinse cycle. In addition, water soluble pouches, nonwoven pouches, powders and tablets may be used.

Another method for using the fabric treatment compositions disclosed herein is to treat a non-woven and/or woven carrier article with the composition. A further embodiment of this method is to add a fragrance to the carrier article. The carrier article is maintained in a moist state until added to the dryer with articles to be treated. It is preferred that the carrier article remain moist to facilitate the transfer of the composition to the treated garments. This method is especially effective on delicate articles including, but not limited to, silk, wool, linen where excessive heat may cause unwanted effects. Furthermore, this method allows for the economical treatment of limited article loads or those containing articles that should not be immersed or exposed to large volumes of liquid.

When the present composition is added to the water present in a washing machine or water present in some other suitable container for soaking or hand-washing of fabrics, an effective amount can be present to effect deposition of the composition onto the fabric. The effective amount for a first treatment operation performed on a previously untreated fabric is typically from about 0.01% to about 10%, preferably from about 0.1% to about 5%, and more preferably from about 0.1% to about 2% of the composition to weight of the fabric present, wherein the ratio of the weight of dry fabric to the weight of water can be within a value between a ratio of 1:100 and 1:1, respectively, of the ratio of the dry fabric weight to water weight present.

Irrespective of the method of application employed to effect treatment of articles, a curing step is employed to complete treatment according to the methods of the present disclosure. Suitable curing step includes drying the articles treated with fabric treatment compositions at a temperature above ambient, but less than about 100° C., and preferably less than about 70° C. Even lower temperatures, such as less than 60° C. and even less than 50° C. may also be used. Also suitable is heated drying, that is heating the article above ambient temperatures, by such means including, but not limited to ironing, steaming, blow drying, drying under a heat lamp, drying near a radiative source of heat, or machine drying in a dryer of the treated articles following treatment with compositions disclosed herein. Curing may also be effected by drying, following by a heating step wherein the treated dried articles are subsequently heated above ambient temperature for a time sufficient to effect treatment according to the methods described herein.

Following a first treatment of a fabric with a dose of a fabric treatment composition according, a subsequent or further treatment of the fabric at a later time may be carried out by applying a second fabric treatment composition. The dosage amount of the second fabric treatment composition may be less than, the same as or greater than the dosage amount that was used during the first treatment. Furthermore, any one or several of the components of the second fabric treatment composition may differ in amount relative to the amount of the analogous component in the first fabric treatment composition. That is, at any time after an initial treatment event, it is possible to again treat a fabric at the first treatment level, at a higher level or a lower level. Moreover, the second fabric treatment composition may have varying amounts of components as compared to the amount of active components in a first fabric treatment composition. A smaller dosing of fabric treatment actives may be desirable in subsequent wash treatments following a first fabric treatment, for example, to replenish the total amount of fabric treatment composition on the fabric.

Some amount of a first fabric treatment composition that was initially deposited on a fabric may become lost due to wear or subsequent untreated washing of the fabric with the passage of time. Replenishment of fabric protective properties on such a fabric by subsequently re-treating a fabric with a second fabric treatment composition is understood to refer to a maintenance level of the composition. In other words, when treating an untreated fabric, the amount of fabric treatment composition that is required to effectively treat a fabric in order to impart desirable fabric protective properties such as stain repellency, etc., will in general be greater for a first treatment than for fabrics that have previously been treated. Thus, subsequent, repeated treatments may generally require significantly lower amounts of fabric treatment composition in order to effectively replenish a fabric treatment composition on the fabric and to maintain a desired level of repellency benefits. Higher or lower, maintenance, levels of a fabric treatment composition may be used in subsequent wash treatments in order to maintain a consistent level of benefits.

Following treatment of a fabric with an initial amount of the inventive fabric treatment composition sufficient to impart stain repellency characteristics to the fabric, subsequent laundering of the fabric can be carried out with amounts of fabric treatment composition to water that are typically from about 0.001% to about 5%, preferably from about 0.01% to about 2%, and more preferably from about 0.01% to about 1%, by weight of the composition to weight of the water present, wherein the ratio of the weight of dry fabric to the weight of water is preferably within a value between a ratio of 1:100 and 1:1, respectively, of the ratio of the dry fabric weight to water weight present.

In still a further aspect, an effective amount of the composition can be added to a standard tumble dryer, with optional ironing. The composition may be used alone in any dryer delivery device, such as a nonwoven or sponge, or combined with fabric softener sheets, home dry cleaning devices, or other dryer device. Thus, another product form is a fabric treatment composition such as a paste, suitable for coating onto, and delivery from, a substrate e.g. a flexible sheet or sponge or a suitable dispenser, such as a container having apertures therein, during a tumble dryer cycle. A method for using the fabric treatment composition is to add or release the composition into the rinse water. When using an aqueous, solid, powder, foam, gel, pouch, tablet or sheet composition for treating fabric in the rinse step, an effective amount of active of the composition disclosed herein may contain fabric softener actives, perfume, electrolytes, chlorine scavenging agents, dye transfer inhibiting agents, dye fixative agents, phase stabilizers, chemical stabilizers including antioxidants, silicones, antimicrobial actives and/or preservatives, chelating agents, aminocarboxylate chelating agents, colorants, enzymes, brighteners, soil release agents, or mixtures thereof.

In still a further aspect of the instant disclosure, textiles treated with the fabric treatment compositions described herein, particularly delicate fabrics, fabrics composed of natural fibers including, but not limited to fur, wool or silks, fabrics comprising inclusions, panels, or mixed woven or non-woven compositions of heat sensitive natural or synthetic fibers including, but not limited to elastomeric materials such as rubber, SPANDEX, polyacetate, vinyl and nylon, may be so treated by any of the means described herein and allowed to dry under ambient conditions without the application of heat in order to prevent shrinking, dimensional distortion, wrinkling, creasing or other such deleterious effects that may be the result of applying heat to the wet textiles or heating the wet textiles sufficiently and for sufficient time to reduce them to an essentially dry state. Advantageously, such fabrics treated by the compositions disclosed herein and allowed to dry under ambient conditions, may subsequently be exposed to a heat source to effect curing of the composition in order to obtain the full benefits of the treatment. Such dry fabrics subsequently exposed to a heat source including, but not limited to heating in an automatic dryer, or contact with steam, an iron, heated air from a blow dryer or other heat source, will not suffer from the deleterious effects noted herein that are commonly seen when such delicate fabrics are dried by heating to dryness starting from a substantially wet state. In this aspect, the time of exposure to a heat source required by textiles treated by the composition of disclosed herein and allowed to dry under ambient conditions, may be substantially reduced compared to the time of exposure to a heat source required if such textiles treated with the composition are brought to dryness directly from a wet state. Such reduced time of exposure to a heat source is beneficial to reduce any deleterious effects noted above for many textiles, particularly those labeled as delicate or dry-clean only textiles.

Drying is a function of both temperature and time. Effective drying can be achieved either by exposing treated garments to effectively higher drying temperatures for a shorter time, or exposing treated garments to effectively longer drying times with correspondingly lower drying temperatures. Preferred temperature and drying times are typically provided by selected cycles of commercially available automatic dryers under normal, permanent press and delicate cycle selections. Highly preferred are cycle selections that provide a short cooling down period with continued tumbling to provide for reduced wrinkling of tumbled fabrics, although this is not a requirement for treating fabrics with the compositions disclosed herein. Drying the fabric at a temperature above 45° C. is preferred.

The compositions and articles of the present invention which contain a fabric improving active can be used to treat fabrics, garments, and the like to provide at least one of the following fabric care benefits: wrinkle removal and/or reduction, fabric wear reduction, fabric pilling reduction, fabric color fading reduction, fabric soiling reduction, fabric shape retention, and/or fabric shrinkage reduction.

The inventive composition can be applied by any of the above methods. In one method of use, a first composition can be first applied at a high effective amount of the requisite actives to give untreated fabrics the beneficial properties. Subsequent treatment of the same fabrics can be applied at a lower maintenance effective amount employing a second composition having requisite actives at a lower level, and therefore more economical usage benefit, but still effective at maintaining the beneficial protective properties provided to the treated fabrics in a first treatment step augmented by treatment in the second treatment step. In another embodiment, a kit consisting of the two treatment compositions as in the preceding embodiment may be employed, a first treatment composition with a first effective level of a hydrophobic agent, a fluoropolymer, and a zeta potential modifier, and optionally one or more additives; and a second treatment composition employed for subsequent and/or repeated treatment(s) to maintain the fabric protective properties provided in the first treatment step, where the second treatment composition has a second effective level of a hydrophobic agent, a fluoropolymer, a zeta potential modifier, and optionally one or more additives.

In one embodiment, a kit having a first fabric treatment composition and a second fabric treatment composition is employed, the kit having a first protective fabric treatment consisting of an aqueous composition having: (a) about 5 to 10 weight % hydrophobic agent; (b) about 5 to 30 weight % fluoropolymer; (c) about 0.1 to 5 weight % zeta potential modifier; (d) optionally, about 0.01 to 10 weight % bleaching agent; (e) optionally, about 0.1 to 10 weight % surfactant; and (f) optionally, an additive; the kit also providing a second protective fabric treatment consisting of a second aqueous composition having (g) about 5 to 10 weight % hydrophobic agent; (h) about 5 to 30 weight % fluoropolymer; and (i) about 0.1 to 5 weight % zeta potential modifier; (j) optionally, 5 to 30 weight % of fluoropolymer; (k) optionally, about 0.01 to 10 weight % bleaching agent; (l) optionally, about 0.1 to 10 weight % surfactant; and (m) optionally, an additive. In one embodiment, the kit is employed in a first operation to first treat a fabric article, and then in a second operation to restore a fabric protective benefit provided by first use of the first fabric protective treatment. In another embodiment, the kit is employed in a first operation to first treat, and then in a second operation to maintain the first fabric protective treatment benefit by a second and/or subsequent series of second treatment steps employing the second treatment composition of the kit. In yet another embodiment, the second and/or subsequent series of second treatment operations may provide an enhanced or different second fabric benefit differing from the first fabric protective benefit provided in a first treatment operation. In a particular embodiment, for example, a first treatment composition has a hydrophobic agent, a fluoropolymer, a zeta potential modifier and a compatible bleaching agent and surfactant to effect deep cleaning and stain removal of residue on a soiled fabric article during a first treatment operation, which provides a first fabric protective benefit having stain and soil release characteristics of reduced soiling; and in a second operation employing a second treatment composition, providing cleaning and maintenance of the protective benefit provided by the first treatment composition.

In another embodiment, the kit includes instructions for use of the first and second compositions for treating fabrics according to the inventive methods described herein to deliver and maintain the desired fabric protective properties, including wrinkle removal and/or reduction, fabric wear reduction, fabric pilling reduction, fabric color fading reduction, fabric soiling reduction, fabric shape retention, and/or fabric shrinkage reduction.

In other embodiments, concentrated compositions can be employed, and used as is or further diluted prior to use. Concentrated compositions comprise a higher level of fabric active, typically from about 1% to about 99%, preferably from about 2% to about 65%, and more preferably from about 3% to about 25%, by weight of the concentrated fabric care composition. Concentrated compositions are used in order to provide a less expensive product. The concentrated product can be used undiluted or diluted by about 1,000,000%, more preferably by about 25,000%, and even more preferably by about 5000% of the composition, by addition by weight of water.

The instant compositions can also be used as ironing aids. An effective amount of the composition can be sprayed onto fabric and the fabric can be ironed at the normal ironing temperature recommended by the fabric label instruction guide. The fabric can be sprayed with an effective amount of the composition, allowed to dry and then ironed, or sprayed and ironed immediately to effect curing.

In a still further aspect, the instant fabric treatment compositions can be sprayed and/or misted onto fabrics and/or entire garments in need of de-wrinkling and/or other fabric care benefits in a manner such that excessive amounts of the fabric/garment care composition are prevented from being released to the open environment, provided in association with instructions for use to ensure that the consumer applies at least an effective amount of fabric improving active and/or fabric care composition, to provide the desired garment care benefit. Any spraying mechanism and/or misting mechanism can be used to apply the fabric care composition to textiles. One distribution of the treatment composition can be achieved using a fog form. The mean particulate diameter size of the fabric care composition fog can be from about 5 microns to about 200 microns, preferably from about 5 microns to about 100 microns, and more preferably from about 10 microns to about 50 microns. The wash or rinse water should contain typically from 0.01 to 1 g of fluoropolymer per liter of wash water and from 0.01 to 1 g of hydrophobic agent per liter of wash water. The especially preferred levels of the inventive composition are from 0.01 to 0.5 g of fluoropolymer per liter of wash water and from 0.01 to 0.5 g of hydrophobic agent per liter of wash water. After treatment with an initial level of the composition, a maintenance level of present composition may be sufficient to maintain the properties. Desirable maintenance levels of the inventive composition can be from 0.01 to 0.2 g of fluoropolymer per liter of wash water and from 0.01 to 0.2 g of hydrophobic agent per liter of wash water. Especially preferred levels of the inventive composition might be from 0.01 to 0.1 g of fluoropolymer per liter of wash water and from 0.01 to 0.1 g of hydrophobic agent per liter of wash water.

The present disclosure also relates to a method for using an aqueous or solid, preferably powder or granular, composition to treat fabrics in a wash cycle, with such compositions comprising the fabric protecting actives, and optionally, surfactants, builders, perfume, chlorine scavenging agents, dye transfer inhibiting agents, dye fixative agents, dispersants, detergent enzymes, heavy metal chelating agents, suds suppressors, fabric softener actives, chemical stabilizers including antioxidants, silicones, antimicrobial actives and/or preservatives, soil suspending agents, soil release agents, optical brighteners, colorants, and the like, or mixtures thereof. Depending on the selection of optional ingredients, such as the level and type of surfactants, the present composition can be used as a wash additive composition (when the surfactant level is low) or as a laundry detergent, which also has additional fabric care benefits. It is preferable that the treatment be performed in accordance with the instructions for use, to ensure that the consumer knows what benefits can be achieved, and how best to obtain these benefits.

The present disclosure also concerns a method for treating fabric in a home laundry drying step, comprising applying an effective amount of the fabric protecting actives of the present invention and, optionally, fabric softener actives, distributing agent, perfume, fiber lubricants, fabric shape retention polymers, lithium salts, potassium salts, phase stabilizers, chlorine scavenging agents, dye transfer inhibiting agents, dye fixative agents, chemical stabilizers including antioxidants, silicones, antimicrobial actives and/or preservatives, heavy metal chelating agents, aminocarboxylate chelating agents, enzymes, brighteners, soil release agents, and mixtures thereof. The present composition can take a variety of physical forms including liquid, foams, gel and solid forms such as solid particulate forms. One method for treating a textile comprises treating a fabric with a dryer-added fabric care composition in combination with a dispensing means such as a flexible substrate which effectively releases the fabric care composition in an automatic tumble clothes dryer. Such dispensing means can be designed for single usage or for multiple uses. Preferably, the composition is applied onto a sheet substrate to form a dryer sheet product.

Another method for imparting fabric protective properties to a textile comprises treating fabrics with a fabric protection composition that is dispensed from a sprayer at the beginning of and/or during a drying cycle. It is preferable that the treating step be performed in accordance with a set of instructions for use, to ensure that the consumer knows what benefits can be achieved, and how best to obtain these benefits. The set of instructions in combination with an amount of fabric treatment composition may together constitute a fabric treatment kit.

The present disclosure also relates to a fabric care method for dipping and/or soaking fabrics before the fabrics are laundered, with a pre-wash fabric care composition as discussed herein, that contains an effective amount of fabric protecting active and, optionally, surfactants, builders, perfume, chlorine scavenging agents, dye transfer inhibiting agents, dye fixative agents, dispersants, detergent enzymes, heavy metal chelating agents, fabric softener actives, chemical stabilizers including antioxidants, silicones, antimicrobial actives and/or preservatives, soil suspending agents, soil release agents, optical brighteners, colorants, and the like, or mixtures thereof. It is preferable that the treatment be performed in accordance with instructions for use, to ensure that the consumer knows what benefits can be achieved, and how best to obtain these benefits.

Examples

Studies were conducted to demonstrate the beneficial effects of the fabric treatment composition and application techniques that can be employed to deliver the treatment compositions described herein. Data and discussions are presented in the discussions and tables that follow. In the following studies, fabric treatment compositions containing fluoropolymers, hydrophobic agents, and zeta potential modifiers were tested for their effectiveness in enhancing water and oil repellency of treated fabrics. Although fragrance and colorant were not added in the compositions tested, these components may be included in commercial products at amounts of about 0.4% and 0.004%, respectively.

In a first series of studies, six compositions each having the same amounts of fluoropolymers and hydrophobic agent, but different amounts of zeta potential modifier (e.g., cationic surfactant in the form of a quaternary ammonium compound) were prepared. The compositions were diluted using water to effective use levels equivalent to 5% by weight of the undiluted compositions. The zeta potential of each composition was measured using two instruments, a Beckman Coulter Delsa™Nano C instrument and from Particle Sizing Systems, a Nicomp 380 ZLS. The compositions were applied onto cotton fabrics with a U.S. Testing Terg-O-Tometer water bath that was maintained at 70° F. (21° C.) into which cotton fabric and sufficient amounts of composition to produce a 5% load by fabric weight was attained. Fabric was exposed to each composition for 3.5 minutes and then dried in a commercial dryer at 150° F. (65.6° C.) for 50 minutes. The contact angles of water and oil that was introduced onto the dried fabric via dropper were measured initially (initial contact angle, or t=0) and again 2 minutes later (t=2 min). The results are set forth in TABLE 1 below.

Contact angle measurements are used to determine the contact angle of both water and oil on a fabric or textile surface as performed using a goniometer. A goniometer manufactured by Ramé Hart, Inc. was used, having an illuminated specimen stage assembly and clamping system allowing a test fabric swatch to be positioned horizontally and clamped with sufficient tension to flatten the swatch to prevent sagging but without causing any substantial stretching or deformation of the swatch. The goniometer has an integral eye piece having both horizontal axis line indicator and an adjustable rotating cross line indicator and angle scale, both independently adjustable by separate veniers. It is important that gloves are worn when handling all samples, tools and fabric test swatches and that all glassware, tools, including rules and cutting implements, and syringes used are carefully cleaned with alcohol, such as isopropyl alcohol, and allowed to dry completely before use. Prior to contact angle measurement, test fabric swatch of approximate dimensions of 2.5 cm by 2.5 cm is clamped into place and the vertical venier adjusted to align the horizontal line (axis) of the eye piece coincident to the horizontal plane of the fabric swatch, and the horizontal position of the stage relative to the eye piece positioned so as to view one side of the test fluid droplet interface region at the swatch surface. Test fabric swatches are preferably cut from larger test fabrics at a variety of randomly selected areas of the test fabric to provide multiple samples for testing.

To determine the contact angle of a test fluid on a fabric swatch, approximately one drop of test fluid in an amount between about 0.010 and about 0.012 g is dispensed onto the swatch using a small syringe fitted with a stainless steel needle and a micrometer drive screw to displace a calibrated amount of the test fluid. For water measurements, purified water, either deionized or distilled, is employed, and for oil measurements, a vegetable oil, such as soybean oil, available from Bunge North America, St. Louis, Mo., is suitably employed. Immediately upon dispensing the test fluid, the rotatable venier is adjustment to align the cross line and cross position, that is the intersection of the rotatable cross line and the fixed horizontal line, coincident with the edge of the test fluid droplet and the swatch, and the cross line angle (rotation) then positioned coincident with the tangent to the edge of the test droplet surface, as imaged by the eye piece. The contact angle is then read from the angle scale, which is equivalent to the tangent angle. The initial contact angle is that angle determined immediately after dispensing the test fluid to the swatch surface, which is taken to be essentially equivalent to time zero (t=0), and subsequent contact angles are then determined at approximately 30 second intervals thereafter to measure either the advancing or receding contact angle of the droplet with respect to the swatch surface, that is either the increasing or decreasing contact angle, respectively.

Initial contact angles above 30 degrees are indicators of effective water or oil repellency. Also suitable are contact angles above 30 degrees that persist over relatively significant contact times, for example around 30 seconds to about 2 minutes. Higher initial contact angles of about 30 degrees and greater and persistent contact angles of about 30 degrees and greater are good indicators of effective water or oil repellency. Cotton weave swatches (also referred to as "flags") were treated with different concentrations of ZONYL 6700 for 12 min in 1500 grams of water at 25° C. in the Terg-O-Tometer, then squeezed and dried in the dryer for 40 min at 150° F. (65.5° C.). The 5% treatment of fluoropolymer solution is 5% as is based on the weight of cotton fabric in the treatment. This corresponds to a rinse cycle concentration of 1.23 grams per liter of rinse water. The contact angle was measured by putting a drop of water on the flags and measuring after 30 sec and 2 min.

TABLE 1

| Sample No. | Composition (wt. %) ZONYL 8300[a] | MICHEM 735[b] | ACCOSOFT 550-75[c] | WATER[d] | Composition Parameters pH (±0.05) | Zeta Pot. (mV)[e] | Zeta Pot. (mV[f] | Contact Angle ($t_0$-$t_2$ min.) Water | Oil |
|---|---|---|---|---|---|---|---|---|---|
| 1 | 34 | 51 | 0 | bal. | 3.60 | −21.2 | 9.1 | 0-0 | 0-0 |
| 2 | 34 | 51 | 2 | bal. | 3.60 | 36.5 | 21.2 | 116-112 | 116-116 |
| 3 | 34 | 51 | 4 | bal. | 3.60 | 45.1 | 27/0 | 111-103 | 115-115 |
| 4 | 34 | 51 | 6 | bal. | 3.60 | 51.7 | 33.6 | 114-107 | 118-118 |
| 5 | 34 | 51 | 8 | bal. | 3.60 | 55.5 | 36.2 | 95-89 | 116-116 |
| 6 | 34 | 51 | 10 | bal. | 3.60 | 57.9 | 36.6 | 70-63 | 105-105 |

Notes to TABLE 1:
[a]Fluoropolymer 18% active.
[b]Paraffin 32% active.
[c]Cationic surfactant 75% active; methyl bis(tallowamido ethyl)-2-hydroxyethyl ammonium methyl sulfate.
[d]"Bal." = balance. Includes small amounts of acid, if necessary to adjust composition pH.
[e]5% (by wt. of fabric) equivalent dilution measured by Beckman instrument.
[f]5% (by wt. of fabric) equivalent dilution measured by Particle Sizing instrument.

As is apparent from the results shown in TABLE 1 above, the formulation containing no zeta potential modifier provided no repellency enhancement. Optimum repellency occurred where the level of this particular zeta potential modifier was between 2-6%; the water repellency decreased when the zeta potential level reached 8% or higher which suggests that too much of the zeta potential modifier may have an adverse effect as well. It is noted that the pH of the compositions were carefully adjusted to 3.60±0.05 for these experiments to minimize experimental variations in the measurement of zeta potential measurement. In practice, the compositions described herein may be adjusted to any desired pH as generally formulated for the intended usage and method of application desired for treating textiles and the like. The suitable operating pH range includes from about pH 1 to about pH 13, although the pH may optimally be adjusted to some value within this range to accommodate the stability and functionality of any optional adjuncts, such as surfactants or enzymes, for example, that perform best at some selected pH.

In a second series of studies, compositions were prepared with differing degrees of cationic character. Each had the same amounts of commercially-available fluoropolymers, hydrophobic agent, and zeta potential modifier. However, suppliers of the commercially-available samples did not disclose specifics about their identity, other than to state whether they were cationic or nonionic in nature. Thus, while the exact identities of the fluoropolymers and hydrophobic agents could not be determined, conclusions could be drawn with respect to the impact of their combined ionic character. The compositions were evaluated on a 10-point scale for their ability to repel water, red wine, and olive oil with 10=Excellent to 1=Poor. See TABLES 2 and 3 below.

TABLE 2

| Sample Nos. | Composition (wt. %) Fluoropolymer Product | Hydrophobic Agent Product | Zeta Potential Modifier |
|---|---|---|---|
| 7-17 | 7.5% | 47.2% | 8.3% |

Note to TABLE 2:
The bulk of the composition, that is approximately 37 wt. %, was water. The pH of the neat inventive composition ranged from 4.6-5.3; the pH in rinse solution was found to be 8.9-9.2.

TABLE 3

| Sample No. | Fluoro-polymer Character | Hydrophobic Agent Character | Water Repellency | Wine Repellency | Oil Repellency |
|---|---|---|---|---|---|
| 7 | Cationic | Nonionic[a] | 10 | 9 | 9 |
| 8 | Nonionic | Nonionic[a] | 10 | 9.5 | 9 |
| 9 | Cationic | Nonionic[a] | 9 | 9 | 8 |
| 10 | Nonionic | Nonionic[a] | 10 | 9 | 8 |
| 11 | Cationic | Nonionic[a] | 9 | 9 | 8 |
| 12 | Cationic | Nonionic[a] | 10 | 6 | 5 |
| 13 | Cationic | Nonionic[a] | 9 | 9 | 8 |
| 14 | Cationic | Nonionic[a] | 8 | 6 | 1 |
| 15 | Cationic | Nonionic[a] | 9 | 5 | 0 |
| 16 | Cationic | Nonionic[a] | 10 | 6 | 0 |
| 17 | Cationic[b] | Cationic | 10 | 10 | 10 |

Notes to TABLE 3:
[a]Same hydrophobic agent as in Sample No. 7.
[b]Same fluoropolymer as in Sample No. 7.

As is apparent from the results shown in TABLE 3 above, the best results were obtained when both the fluoropolymer and the hydrophobic agent were cationic in nature (sample 17). While not being bound by theory, it is believed that this is due to their enhanced compatibility with the zeta potential modifier.

In a third set of studies, three different treatment compositions were formulated and their effectiveness in enhancing water and oil repellency was tested in conjunction with either a liquid or dry form of TIDE® anionic detergent ("Tide-Liquid" or "Tide-Dry," respectively), available from Procter & Gamble Co.). Each composition had different amounts of zeta potential modifier. The fabrics were treated in a commercial Kenmore Model 110 washer (69 liter capacity, 6 lb (2.72 kg) ballast, 12 minute wash cycle at 93° F., or 34° C., and 3 minute rinse cycle at 68° F., or 20° C.). The fabrics tested in each case included a combination comprising 70% cotton material and 30% of a cotton/synthetic blend, which is designated p/c. The detergent, when employed, was added in the wash cycle. The treatment composition was added in the rinse cycle and, in one case, fabric softener, which included cationic surfactants, was also added in the rinse cycle.

It was expected that a small amount of detergent would adhere to the damp fabric following the wash cycle so that the residual detergent would re-dissolve into the water at the beginning of the rinse cycle. The results are presented in TABLE 4 below.

TABLE 4

| Sample No. | Composition (wt. %) ZONYL 8300[a] | MICHEM 735[b] | ACCOSOFT 550-75[c] | WATER[d] | pH (±0.05) | Commercial Product[e] Added to: Wash Cycle | Rinse Cycle/ (Amt. of Sample added (g)) | Water Contact Angle $t_0$-$t_2$ (min.) Cotton | Polyester/ Cotton | Oil Contact Angle $t_0$-$t_2$ (min.) Cotton | Polyester/ Cotton |
|---|---|---|---|---|---|---|---|---|---|---|---|
| 18a | 34 | 51 | 6 | bal. | 3.60 | none | none/ (219) | 88-78 | 97-85 | 100-96 | 100-94 |
| 18b | " | " | " | " | " | Tide-Liquid | none/ (219) | 69-45 | 0-0 | 0-0 | 0-0 |
| 18c | " | " | " | " | " | Tide-Liquid | Downy (219) | 99-78 | 102-90 | 112-112 | 110-110 |
| 19a | 34 | 51 | 10.6 | bal. | 3.60 | none | none/ (219) | 109-89 | 114-106 | 113-110 | 115-110 |
| 19b | " | " | " | " | " | Tide-Liquid | none/ (219) | 108-87 | 100-93 | 106-106 | 117-113 |
| 19c | " | " | " | " | " | Tide-Dry | none/ (219) | 103-87 | 118-106 | 118-114 | 114-113 |
| 19d | " | " | " | " | " | Tide-Liquid | none/ (219) | 118-98 | 112-98 | 111-104 | 112-108 |
| 19e | " | " | " | " | " | Tide-Liquid | none/ (177) | 109-84 | 112-86 | 102-98 | 107-106 |
| 19f | " | " | " | " | " | Tide-Liquid | none/ (118) | 0-0 | 0-0 | 0-0 | 0-0 |
| 20a | 34 | 51 | 13.1 | bal. | 3.60 | Tide-Liquid | none/ (219) | 104-94 | 110-98 | 108-102 | 121-118 |
| 20b | " | " | " | " | " | Tide-Liquid | none/ (177) | 100-85 | 113-103 | 110-108 | 111-108 |
| 20c | " | " | " | " | " | Tide-Liquid | none/ (118) | 72-0 | 102-0 | 85-55 | 87-73 |

Notes to TABLE 4:
[a]Fluoropolymer 18% active.
[b]Paraffin 32% active.
[c]Cationic surfactant 75% active; methyl bis(tallowamido ethyl)-2-hydroxyethyl ammonium methyl sulfate.
[d]"Bal." = balance. Includes small amounts of acid as needed to adjust composition pH.
[e]"Tide-L" = Tide liquid; "Dry" = Tide powder. Tide detergent and Downy fabric softener are available from Procter & Gamble Co.

As is apparent from the results in TABLE 4, compositions containing 6% zeta potential modifier, as shown in Sample Nos. 18a-c, performed well in terms of repellency in the absence of added washing detergent, but Sample Nos. 18a and 18b performed poorly when detergent was added in the wash cycle. However, the same formulation exhibited good repellency performance when a fabric softener was added to the rinse cycle, as shown in Sample No. 18c, to increase the amount of cationic surfactant, i.e., zeta potential modifier.

In addition, it was found that increasing the level of the zeta potential modifier (i.e., ACCOSOFT 550-75) to 10.6% as shown for Samples 19a-f improved soil repellency performance when detergent was present in the wash cycle, even with an increase in zeta potential modifier. However, soil repellency actually decreased at lower dosage levels (i.e., 118 g) when detergent was present in the wash. This suggests that the amount of zeta potential modifier was insufficient to counteract the adverse effects of the anionic surfactants in the detergent. However, when the amount of zeta potential modifier was increased to 13.1% (Samples Nos. 9a-c), an improvement in repellency performance was seen, even at a lower dose of treatment composition (i.e., 118 g) when detergent was present.

In a fourth set of studies, evaluation of repellency was visually determined by applying drops of water onto the surface of treated fabrics and observing whether or not they were absorbed or beaded up on the fabric. A formulation (Sample 21) prepared according to the instant disclosure, was used to evaluate repellency performance in different washing machines. See TABLE 5.

TABLE 5

| Sample No. | Composition (wt. %) Freepel 1225[a] | Nuva N2116[b] | ACCOSOFT 550-90%[c] | Water[d] | Fragrance |
|---|---|---|---|---|---|
| 21 | 47.2 | 15.0 | 8.3 | 29.0 | 0.5 |

Notes to TABLE 5
[a]Paraffin, 25% active.
[b]Fluoropolymer, 30% active.
[c]Cationic surfactant 90% active (methyl bis(tallowamido ethyl)-2-hydroxyethyl ammonium methyl sulfate.

First, the formula was introduced to a in a commercial Kenmore Model 110 washer (69 liter capacity, 6 lb (2.72 kg) ballast, 12 minute wash cycle at 93° F., or 34° C., and 3 min. rinse cycle at 68° F., or 20° C.). The fabrics tested in each case included a combination comprising 70% cotton material and 30% of a cotton/synthetic blend, which is designated p/c. The detergent was added in the wash cycle. The treatment composition was added directly thereafter in the rinse cycle. The results are shown in Trial No. 1 in TABLE 6 below.

Second, this treatment was repeated in a Samsung VRT Plus 5 cu. ft. White Front Load Washer (approximately 15 liters water per cycle, 6 lb (2.72 kg) ballast, normal 30 minute wash cycle at 93° F., or 34° C., and 3 min. rinse cycle at 68° F., or 20° C.). The detergent (Liquid Tide) was added to the detergent compartment of the laundry dispenser; 100 mL of the inventive treatment was added to the fabric softener compartment of the laundry dispenser. The results are shown in Trial No. 2 in TABLE 6 below.

Third, this treatment was repeated in the same Samsung VRT Plus 5 cu. ft. White Front Load Washer. The Extra Rinse option was selected: following the wash cycle, an intermediate rinse is effected with no added laundry product, followed by a final rinse containing the inventive treatment. The detergent (Liquid Tide) was added to the detergent compartment of the laundry dispenser; 100 mL of the inventive treatment was added to the fabric softener compartment of the laundry dispenser. The results are shown in Trial No. 3 in TABLE 6 below.

Fourth, this treatment was repeated in the same Samsung VRT Plus 5 cu. ft. White Front Load Washer. The detergent (Liquid Tide) was added to the detergent compartment of the laundry dispenser; no product was added to the fabric softener compartment of the laundry dispenser. Following this treatment, an additional "Rinse+Spin" option was effected, in which the load was exposed to a rinsing cycle (optionally containing laundry treatment), followed by a draining and spin process. 100 mL of the inventive treatment was added to the fabric softener compartment of the laundry dispenser, and the process was initiated. The results are shown in Trial No. 4 in TABLE 6 below.

As is apparent from TABLE 6, use of the inventive treatment in a top-loading, deep-filling washing machine in a rinse cycle directly following a wash cycle yields good repellency results, see Trial No. 1. Further, addition of product to a front-loading, low-water (high efficiency) washing machine in a rinse cycle directly following a wash cycle yields less-than-optimal repellency results, see Trial No. 2. Finally, addition of product to a front-loading, low-water (high efficiency) washing machine in a rinse cycle directly following an intermediate rinse cycle essentially devoid of surfactants yields good repellency results, see Trial Nos. 3 and 4.

TABLE 6

| Trial No. | Washing Machine Description | Process | Added to Wash Cycle | Added to First Rinse/ (Amt of Sample added (g)) | Added to Second Rinse/ (Amt of Sample added (g)) | Water Repellency |
|---|---|---|---|---|---|---|
| 1 | Top Load, Deep Fill | Normal wash, First rinse | Liquid Tide | Sample No. 21/ (100 g) | n/a | Good |
| 2 | Front-Load, Low-Water | Normal wash, First rinse | Liquid Tide | Sample No. 21/ (100 g) | n/a | Poor |
| 3 | Front-Load, Low-Water | Normal wash, First rinse, Second rinse | Liquid Tide | n/a | Sample No. 21/ (100 g) | Good |
| 4 | Front-Load, Low-Water | Normal wash, First rinse, Second rinse, Spin | Liquid Tide | n/a | Sample No. 21/ (100 g) | Good |

It is to be noted that the foregoing examples demonstrate the manner in which the methods of the present disclosure provide for increased fabric protective benefits, including, but not limited to improved repellency against water and oil. It is further noted that the benefits with respect to improved repellency against water and oil also pertain to water-base, oil-based stains, respectively, and to particulate stains, and mixtures thereof. The foregoing examples further demonstrate the manner in which the methods of the present disclosure provide for improved hand-feel to treated fabrics. The foregoing examples also demonstrate the manner in which the methods disclosed herein provide improved fabric protective benefits without effectively reducing the breathability of treated fabrics with respect to water or moisture transmission.

Although only preferred embodiments of the fabric treatment compositions are specifically disclosed and described herein, it will be appreciated that many modifications and variations of these disclosures are possible in light of the above teachings and remain within the purview of the appended claims without departing from the spirit and intended scope of the disclosure.

What is claimed is:

1. A method for treating fabrics in a high efficiency washing machine using less than about 20 liters per laundry cycle to provide at least one fabric protective property to a fabric, comprising the steps of:

(1) washing the fabric with a detergent composition comprising at least one anionic surfactant;

(2) rinsing the fabric in a first rinse cycle essentially devoid of surfactant-containing additives;

(3) depositing a first fabric treatment composition onto the fabric in a first treatment liquor in a second or subsequent rinse cycle following at least one rinse cycle of step (2), wherein the first fabric treatment composition comprises:

a) 9.3 to 14.3 weight % of a first amount of a hydrophobic agent that does not cause any significant color change, nor impart any discoloration to a fabric, characterized as having a melting point or glass transition temperature of less than 100° C.;

b) 2.0 to 7.0 weight % of a first amount of a fluoropolymer; and c) 5.0 to 10.0weight % of a first effective amount of a zeta potential modifier, such that the first treatment liquor has a zeta potential that is positive and greater than zero millivolts; and (4) curing the fabric at a temperature above ambient temperatures but less than 70° C. following depositing step (3);

wherein:

i) the fabric protective property is selected from the group consisting of increased water repellency, increased oil repellency, increased soil and stain release, improved hand-feel, improved softness, improved resistance to damage, and any combination thereof;

ii) the hydrophobic agent is selected from the group consisting of hydrophobic waxes, emulsifiable waxes and combinations thereof;

iii) the fluoropolymer is a fluorochemical acrylate polymer; and iv) the zeta potential modifier comprises a quaternary ammonium salt.

2. The method of claim 1, further comprising repeating step (3) and step (4) a plurality of times.

3. The method of claim 1, wherein step (3) is repeated at least once prior to curing step (4).

4. The method of claim 1, further comprising the step of:

(5) depositing a second fabric treatment composition onto the fabric in a second treatment liquor subsequent to depositing step (3) and prior to curing step (4), wherein the second fabric treatment composition comprises:

d) 0.5 to 60 weight % of a second amount of a hydrophobic agent that is not a fluoropolymer, does not cause any significant color change, nor impart any discoloration to a fabric, characterized as having a melting point or glass transition temperature of less than 100° C.;

e) 0.5 to 60 weight % of a second amount of a fluoropolymer; and f) 0.1 to 30 weight % of a second effective amount of a zeta potential modifier, such that the second treatment liquor has a zeta potential that is positive and greater than zero millivolts.

5. The method of claim 4, wherein step (5) is repeated at least once prior to curing or drying step (4).

6. The method of claim 5, further comprising the step of (6) curing the fabric at a temperature above ambient temperatures but less than 70° C.

7. The method of claim 6, wherein step (5) together with any repetitions thereof together with step (6) occur after the completion of step (3) and any repetitions thereof, together with step (4).

8. The method of claim 7, wherein the second fabric treatment composition comprises:

d) 0.1 to 30 weight % hydrophobic agent;

e) 0.1 to 30 weight % fluoropolymer; and f) 0.1 to 30 weight % zeta potential modifier.

9. The method of claim 5, wherein the hydrophobic agent of the second fabric treatment composition is selected from the group consisting of hydrophobic waxes, emulsifiable waxes and combinations thereof.

10. The method of claim 1, wherein the quaternary ammonium salt is selected from the group consisting of, alkyl trimethyl ammonium salts, dialkyl dimethyl ammonium salts, trialkylammonium acetates, alkyldimethylbenzyl ammonium salts, dialkylmethylbenzyl ammonium salts, alkylpyridinium halide and alkyl pyridinium salts, alkylthiomethylpyridinium salts, alkylamidomethylpyridinium salts, alkylquinolinium salts, alkylisoquinolinium salts, N,N-alkylmethylpyrollidinium salts, 1,1-dialkylpiperidinium salts, 4,4-dialkylthiomorpholinium salts, 4,4-dialkylthiomorpholinium-1-oxide salts, methyl bis(alkyl ethyl)-2-alkyl imidazolinium methyl sulfate, methyl bis(alkylamido ethyl)-2-hydroxyethyl ammonium methyl sulfate, alkylamidopropyl-dimethylbenzyl ammonium salts, carboxyalkyl-alkyldimethyl ammonium salts, poly(vinylmethylpyridinium) salts, poly(vinylpyridine) salts, and combinations thereof.

11. The method of claim 4, wherein the quaternary ammonium salt is selected from the group consisting of, alkyl trimethyl ammonium salts, dialkyl dimethyl ammonium salts, trialkylammonium acetates, alkyldimethylbenzyl ammonium salts, dialkylmethylbenzyl ammonium salts, alkylpyridinium halide and alkyl pyridinium salts, alkylthiomethylpyridinium salts, alkylamidomethylpyridinium salts, alkylquinolinium salts, alkylisoquinolinium salts, N,N-alkylmethylpyrollidinium salts, 1,1-dialkylpiperidinium salts, 4,4-dialkylthiomorpholinium salts, 4,4-dialkylthiomorpholinium-1-oxide salts, methyl bis(alkyl ethyl)-2-alkyl imidazolinium methyl sulfate (and other salts), methyl bis(alkylamido ethyl)-2-hydroxyethyl ammonium methyl sulfate, alkylamidopropyl-dimethylbenzyl ammonium salts, carboxyalkyl-alkyldimethyl ammonium salts, poly(vinylmethylpyridinium) salts, poly(vinylpyridine) salts, and combinations thereof.

12. The method of claim 1, wherein the first fabric treatment composition further comprises 20 to 80 weight % of an aqueous liquid carrier that includes a low molecular weight organic solvent.

13. The method of claim 4, wherein the second fabric treatment composition further comprises 20 to 80 weight % of an aqueous liquid carrier that includes a low molecular weight organic solvent.

14. The method of claim 1, wherein the hydrophobic agent has a melting point or glass transition temperature between 45° C. and 100° C.

15. The method of claim 1, wherein the fabric protective property is a non-permanent fabric protective property.

16. The method of claim 4, wherein the second fabric treatment composition comprises:

a) 5 to 25 weight % of the hydrophobic agent;

b) 0.5 to 10 weight % of the fluoropolymer; and c) 0.5 to 15 weight % of the zeta potential modifier.

17. The method of claim 8, wherein the second fabric treatment composition comprises:

d) 5 to 20 weight % of the hydrophobic agent;

e) 1 to 10 weight % of the fluoropolymer; and f) 1 to 15 weight % of the zeta potential modifier.

* * * * *